US008698720B2

(12) United States Patent
Kaneda et al.

(10) Patent No.: US 8,698,720 B2
(45) Date of Patent: Apr. 15, 2014

(54) DISPLAY SIGNAL PROCESSING DEVICE AND DISPLAY DEVICE

(75) Inventors: Harutoshi Kaneda, Fukaya (JP); Koji Shigehiro, Kumagaya (JP)

(73) Assignee: Japan Display Inc., Tokyo (JP)

( * ) Notice: Subject to any disclaimer, the term of this patent is extended or adjusted under 35 U.S.C. 154(b) by 1839 days.

(21) Appl. No.: 11/507,439

(22) Filed: Aug. 22, 2006

(65) Prior Publication Data

US 2006/0279498 A1 Dec. 14, 2006

Related U.S. Application Data

(63) Continuation of application No. PCT/JP2005/002932, filed on Feb. 23, 2005.

(30) Foreign Application Priority Data

Feb. 23, 2004 (JP) ..... 2004-046898

(51) Int. Cl.
*G09G 3/36* (2006.01)

(52) U.S. Cl.
USPC ..... 345/89; 345/87

(58) Field of Classification Search
USPC ..... 345/87–104
See application file for complete search history.

(56) References Cited

U.S. PATENT DOCUMENTS

| | | | | |
|---|---|---|---|---|
| 6,107,981 | A * | 8/2000 | Fujita | 345/95 |
| 6,140,989 | A | 10/2000 | Kato | |
| 7,006,065 | B1 * | 2/2006 | Sugawara et al. | 345/89 |
| 7,030,840 | B2 * | 4/2006 | Mametsuka | 345/76 |
| 7,262,756 | B2 * | 8/2007 | Nakagawa et al. | 345/89 |
| 2001/0015835 | A1 * | 8/2001 | Aoki | 358/525 |
| 2002/0186230 | A1 * | 12/2002 | Kudo et al. | 345/690 |
| 2003/0043132 | A1 * | 3/2003 | Nakamura | 345/204 |
| 2003/0142363 | A1 * | 7/2003 | Oota | 358/401 |
| 2003/0234800 | A1 * | 12/2003 | Nakajima et al. | 345/690 |
| 2004/0036706 | A1 * | 2/2004 | Endou | 345/690 |
| 2004/0046724 | A1 * | 3/2004 | Woo et al. | 345/87 |
| 2004/0085635 | A1 * | 5/2004 | Nakagawa et al. | 359/443 |
| 2004/0090409 | A1 * | 5/2004 | Nakata et al. | 345/89 |
| 2004/0222955 | A1 * | 11/2004 | Koyama | 345/87 |
| 2004/0257252 | A1 * | 12/2004 | Wei | 341/141 |

(Continued)

FOREIGN PATENT DOCUMENTS

| | | |
|---|---|---|
| CN | 1405745 | 3/2003 |
| CN | 1434432 | 8/2003 |

(Continued)

OTHER PUBLICATIONS

Microfilm of the specification and drawings annexed to the request of Japanese Utility Model Application No. 122453/1988 (Laid-open No. 45521/1990), Sanyo Electric Co., Ltd., Mar. 28, 1990.

*Primary Examiner* — Alexander Eisen
*Assistant Examiner* — Nelson Lam
(74) *Attorney, Agent, or Firm* — Oblon, Spivak, McClelland, Maier & Neustadt, L.L.P.

(57) ABSTRACT

A display signal processing device includes a reference gradation voltage generating circuit that generates ten reference gradation voltages, and a D/A converting circuit that converts a video signal to a pixel voltage by selectively using the ten reference gradation voltages obtained from the reference gradation voltage generating circuit. The reference gradation voltage generating circuit includes four variable voltage generating sections that generate output voltages, which are varied for gamma correction, and nine resistors that are connected to divide difference voltages obtained between output terminals of the four variable voltage generating sections into the ten reference gradation voltages.

6 Claims, 19 Drawing Sheets

(56) References Cited

U.S. PATENT DOCUMENTS

| | | | | |
|---|---|---|---|---|
| 2005/0253785 | A1* | 11/2005 | Miyasaka et al. | 345/63 |
| 2006/0097974 | A1* | 5/2006 | Hashimoto et al. | 345/98 |
| 2007/0097060 | A1* | 5/2007 | Takahashi | 345/98 |

FOREIGN PATENT DOCUMENTS

| | | |
|---|---|---|
| CN | 1475979 | 2/2004 |
| JP | 6-4046 | 1/1994 |
| JP | 6-89073 | 3/1994 |
| JP | 8-263019 | 10/1996 |
| JP | 2001-343955 | 12/2001 |
| JP | 2002-366112 | 12/2002 |
| JP | 2003-228332 | 8/2003 |
| JP | 2003-295842 | 10/2003 |
| JP | 2004-165749 | 6/2004 |
| TW | 522372 | 3/2003 |

* cited by examiner

| Input gradation value | Output gradation value |
|---|---|
| 63 | 63 |
| 62 | 63 |
| 61 | 62 |
| 60 | 61 |
| 59 | 61 |
| 58 | 59 |
| 57 | 57 |
| ⋮ | ⋮ |
| 6 | 6 |
| 5 | 4 |
| 4 | 2 |
| 3 | 2 |
| 2 | 1 |
| 1 | 0 |
| 0 | 0 |

| Register type | Positive polarity data | Negative polarity data | Setup object |
|---|---|---|---|
| Inclination tuning | PRP0[2:0] | PRN0 [2:0] | Variable resistor VRH |
| | PRP1[2:0] | PRN1 [2:0] | Variable resistor VRL |
| Amplitude tuning | VRP0[3:0] | VRN0 [3:0] | Variable resistor VR0 |
| | VRP1[4:0] | VRN1 [4:0] | Variable resistor VR1 |
| Fine tuning | PKP0[2:0] | PKN0 [2:0] | Selector 75A (voltage level of V1) |
| | PKP1[2:0] | PKN1 [2:0] | Selector 75B (voltage level of V8) |
| | PKP2[2:0] | PKN2 [2:0] | Selector 75C (voltage level of V20) |
| | PKP3[2:0] | PKN3 [2:0] | Selector 75D (voltage level of V43) |
| | PKP4[2:0] | PKN4 [2:0] | Selector 75E (voltage level of V55) |
| | PKP5[2:0] | PKN5 [2:0] | Selector 75F (voltage level of V62) |

F I G. 24

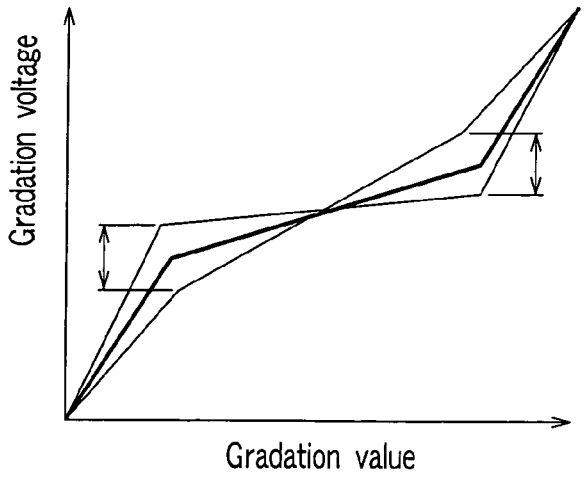

F I G. 25

DISPLAY SIGNAL PROCESSING DEVICE AND DISPLAY DEVICE

CROSS-REFERENCE TO RELATED APPLICATIONS

This is a Continuation Application of PCT Application No. PCT/JP2005/002932, filed Feb. 23, 2005, which was published under PCT Article 21(2) in Japanese.

This application is based upon and claims the benefit of priority from prior Japanese Patent Application No. 2004-046898, filed Feb. 23, 2004, the entire contents of which are incorporated herein by reference.

BACKGROUND OF THE INVENTION

1. Field of the Invention

The present invention relates generally to display signal processing and display devices for converting a display signal to a pixel voltage, and more particularly to display signal processing and display devices for converting a display signal to a gamma-corrected pixel voltage.

2. Description of the Related Art

A flat-panel display device, which is represented by a liquid crystal display device, is widely used as a display device for a personal computer, a mobile information terminal, a TV, a car navigation system, etc.

In general, the liquid crystal display device comprises a display panel including a matrix array of liquid crystal pixels, and a drive circuit for driving the display panel. A typical display panel has a structure in which a liquid crystal layer is held between an array substrate and a counter-substrate. The array substrate includes a plurality of pixel electrodes that are arrayed in a matrix. The counter-substrate includes a common electrode facing the pixel electrodes. The pixel electrode and the common electrode constitute a liquid crystal pixel together with a pixel region of the liquid crystal layer located therebetween. The alignment state of liquid crystal molecules in the pixel region is controlled by an electric field that is applied between the pixel electrode and the common electrode. In the drive circuit, a digital display signal for each pixel is converted to a pixel voltage by selectively using a predetermined number of reference gradation voltages, and output to the display panel. The pixel voltage is a voltage that is applied to the pixel electrode, with the potential of the common electrode used as a reference.

A conventional reference gradation voltage generating circuit is formed, for example, of ladder resistors that include resistors connected in series between a pair of power terminals and divides the voltage between the power terminals to output a predetermined number of reference gradation voltages (see, e.g. Jpn. Pat. Appln. KOKAI Publication No. 2002-228332).

To express the reproduction characteristic of the liquid crystal display device, a reproduction characteristic curve is used in a graph whose abscissa represents logarithmic values of luminance of a subject itself, such as a scene or a person and ordinate represents logarithmic values of luminance of a reproduction image displayed thereon. When $\theta$ represents the inclination angle of the reproduction characteristic curve, tan $\theta$ is called "gamma". Assume that high fidelity is obtainable in the luminance of the reproduction image displayed for the subject, the reproduction characteristic curve forms a linear line whose inclination angle $\theta$ is 45°. Since tan 45°=1, the gamma is 1. In other words, the gamma needs to be corrected to 1 in order to obtain high fidelity in the luminance of the reproduction image displayed for the subject. In the above-described reference gradation voltage generating circuit, even if the resistance of the ladder resistor is tuned for gamma correction, it is difficult to make the luminance of the liquid crystal pixel proportional to the gradation value of the display signal.

A technique of gamma correction using reference gradation voltages from a reference gradation voltage generating circuit is conventionally known, for instance, from the disclosure of Jpn. Pat. Appln. KOKAI Publication No. 2001-134242.

In the prior art, however, the same gamma correction is executed for all the three primary colors of red (R), green (G) and blue (B). Consequently, the color balance between red, green and blue is impaired when the luminance of each color is determined as a result of selection from a predetermined number of gradations including black and white. In particular, the luminance of blue after gamma correction is significantly deviated on the side of black, compared to the other colors.

BRIEF SUMMARY OF THE INVENTION

The present invention has been made in consideration of the above-described problems, and an object of the invention is to provide a display signal processing device and display device that can convert a display signal to a gamma-corrected pixel voltage without considerably increasing manufacturing cost.

According to the present invention, there is provided a display signal processing device comprising: a reference gradation voltage generating circuit that generates a first predetermined number of reference gradation voltages; and a signal converting circuit that converts a display signal to a pixel voltage by selectively using the first predetermined number of reference gradation voltages from the reference gradation voltage generating circuit, wherein the reference gradation voltage generating circuit includes a second predetermined number of variable voltage generating sections that generate output voltages, which are varied for gamma correction, the second predetermined number being less than the first predetermined number, and a plurality of resistors connected to divide difference voltages between output terminals of the second predetermined number of variable voltage generating sections into the first predetermined number of reference gradation voltages.

According to the invention, there is also provided a display device comprising: a plurality of pixels that are arrayed substantially in a matrix and each contain a liquid crystal material between first and second electrodes; a reference gradation voltage generating circuit that generates a first predetermined number of reference gradation voltages; a signal converting circuit that converts a display signal to a pixel voltage which is applied to the first electrode, by selectively using the first predetermined number of reference gradation voltages from the reference gradation voltage generating circuit; a common voltage generating circuit that generates a common voltage which is applied to the second electrode; and a control section that controls the signal converting circuit and the common voltage generating circuit to cyclically level-invert the pixel voltage and the common voltage, wherein the reference gradation voltage generating circuit includes a second predetermined number of variable voltage generating sections that generate output voltages, which are varied for gamma correction, the second predetermined number being less than the first predetermined number, and a plurality of resistors connected to divide difference voltages between output terminals of the second predetermined number of variable voltage generating sections into the first predetermined number of reference gradation voltages.

In the display signal processing device and the display device, a plurality of resistors are connected to divide difference voltages between output terminals of the second predetermined number of variable voltage generating sections into the first predetermined number of reference gradation voltages. In short, since the first predetermined number of reference gradation voltages are obtained by using the second predetermined number of variable voltage generating sections, which is less than the first predetermined number, the display signal can be converted to the gamma-corrected pixel voltage, without considerably increasing manufacturing cost.

BRIEF DESCRIPTION OF THE SEVERAL VIEWS OF THE DRAWING

FIG. 24 shows a list of signal names and setup objects stored in the respective registers shown in FIG. 23;

FIG. 25 is a graph that shows the gradation value-gradation voltage characteristic obtained as a result of inclination tuning that is executed in the gamma correction circuit shown in FIG. 23;

DETAILED DESCRIPTION OF THE INVENTION

Figure 1:
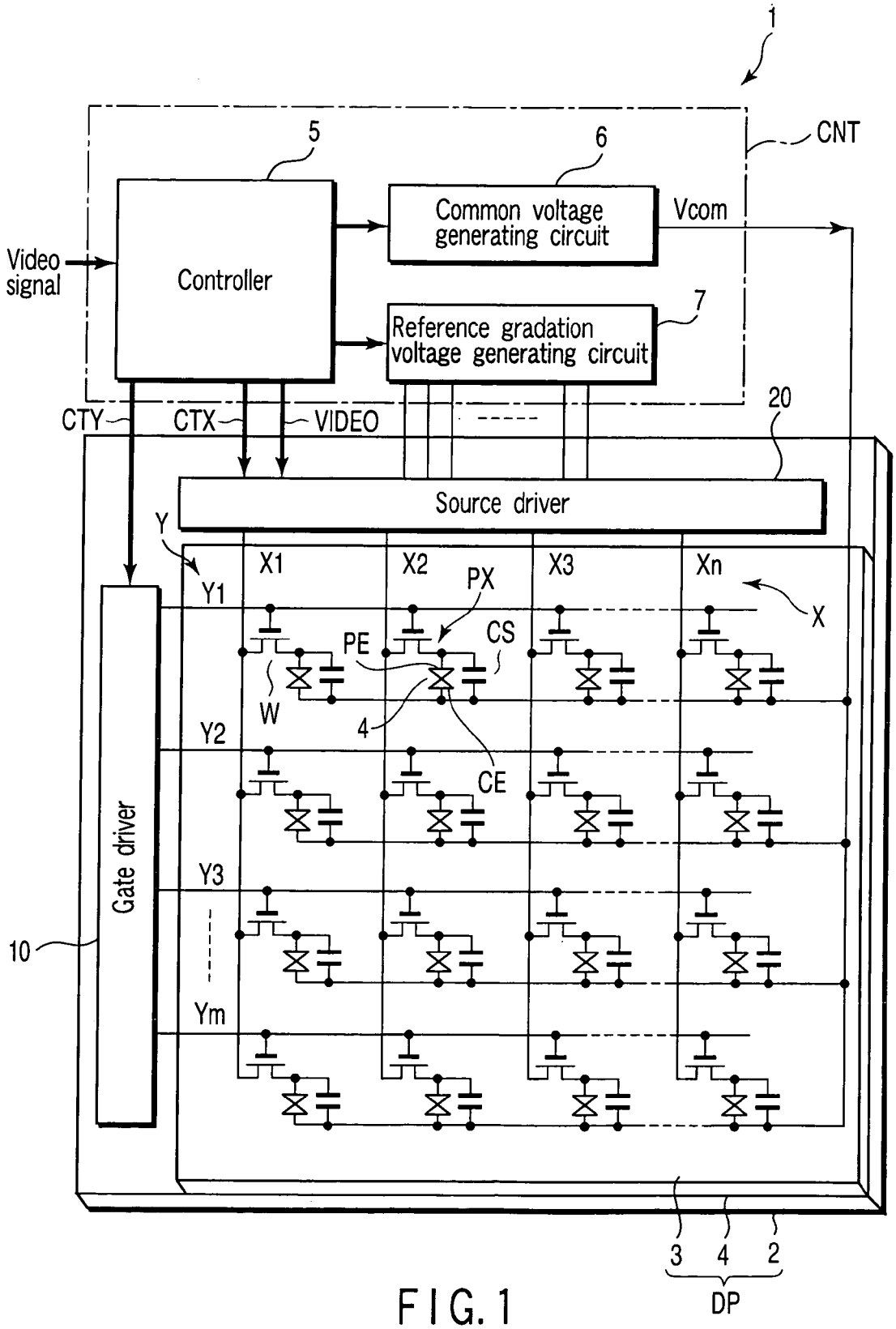
FIG. 1 schematically shows the circuit configuration of a liquid crystal display device according to a first embodiment of the present invention.

A liquid crystal display device according to a first embodiment of the present invention, in which H/common inversion is executed, will now be described with reference to the accompanying drawings. FIG. 1 schematically shows the circuit configuration of the liquid crystal display device 1. The liquid crystal display device 1 includes a display panel DP providing an array of liquid crystal pixels PX, and a control unit CNT that controls the display panel DP. The display panel DP has a structure in which a liquid crystal layer 4 is held between an array substrate 2 and a counter-substrate 3.

The array substrate 2 includes a plurality of pixel electrodes PE that are arrayed in a matrix on a transparent insulating substrate such as a glass substrate; a plurality of gate lines Y (Y1 to Ym) that are arranged along the rows of pixel electrodes PE; a plurality of source lines X (X1 to Xn) that are arranged along the columns of pixel electrodes PE; pixel switching elements W that are arranged near intersections between the gate lines Y and source lines X; a gate driver 10 that sequentially drives the gate lines Y at a rate of 1 gate line Y in 1 horizontal scan period; and a source driver 20 that drives the source lines X while each gate line Y is being driven. Each pixel switching element W is formed of, e.g. a polysilicon thin-film transistor. In this case, the gate of the thin-film transistor is connected to one gate line Y, and the source and drain thereof are connected between one source line X and one pixel electrode PE, thereby forming a source-drain path between the source line X and pixel electrode PE. The gate driver 10 is constructed using polysilicon thin-film transistors that are formed together with those for the pixel switching elements W in the same manufacturing step. The source driver 20 is an integrated circuit (IC) chip that is mounted on the array substrate 2 by a COG (Chip On Glass) technique.

The counter-substrate 3 includes a color filter (not shown) disposed on a transparent insulating substrate such as a glass substrate, and a common electrode CE disposed on the color filter to face the pixel electrodes PE. Each pair of pixel electrode PE and common electrode CE is formed of transparent electrode material such as ITO, and associated with a pixel region of the liquid crystal layer 4 held therebetween to form a liquid crystal pixel PX in which the alignment state of liquid crystal molecules is controlled according to an electric field between the electrodes PE and CE. All the pixels PX have storage capacitances Cs, which are obtained by capacitive coupling between the rows of pixel electrodes PE and a plurality of storage capacitance lines disposed on the array substrate 2 side and electrically connected to the common electrode CE.

The control unit CNT includes a controller 5, a common voltage generating circuit 6 and a reference gradation voltage generating circuit 7. The controller 5 controls the common voltage generating circuit 6, reference gradation voltage generating circuit 7, gate driver 10 and source driver 20, so that a digital video signal VIDEO supplied externally is displayed on the display panel DP as an image. The common voltage generating circuit 6 generates a common voltage Vcom, that is applied to the common electrode CE on the counter-substrate 3. The reference gradation voltage generating circuit 7 generates a first predetermined number of reference gradation voltages VREF that are used to convert, e.g. a 6-bit display signal obtained for each pixel from the video signal to a pixel voltage. The pixel voltage is a voltage that is applied to the pixel electrode PE, with the potential of the common electrode CE used as a reference. In the present embodiment, the first predetermined number of reference gradation voltages VREF are 10 reference gradation voltages V0 to V9. These reference gradation voltages V0 to V9 are set to have levels that become relatively higher toward the reference gradation voltage V0 and become relatively lower toward the reference gradation voltage V9.

The controller 5 generates, for instance, a control signal CTY for a control of sequentially selecting the gate lines Y in each vertical scan period, and a control signal CTX for a control of assigning display signals, which are included in the video signal for a row of pixels PX, to the source lines X in each horizontal scan period (1H). The control signal CTX includes a horizontal start signal STH, which is a pulse that is generated in each horizontal scan period (1H), and a horizontal clock signal CKH, which are pulses that are generated by a number equal to the number of source lines in each horizontal scan period. The control signal CTY is fed from the controller 5 to the gate driver 10, and the control signal CTX is fed from the controller 5 to the source driver 20 along with the digital video signal VIDEO.

The gate driver 10 sequentially selects the gate lines Y under the control of the control signal CTY, and supplies a scan signal to a selected gate line Y to render the pixel switching element W conductive. In the present embodiment, the rows of pixels PX are selected in turn for one horizontal scan period.

Figure 2:
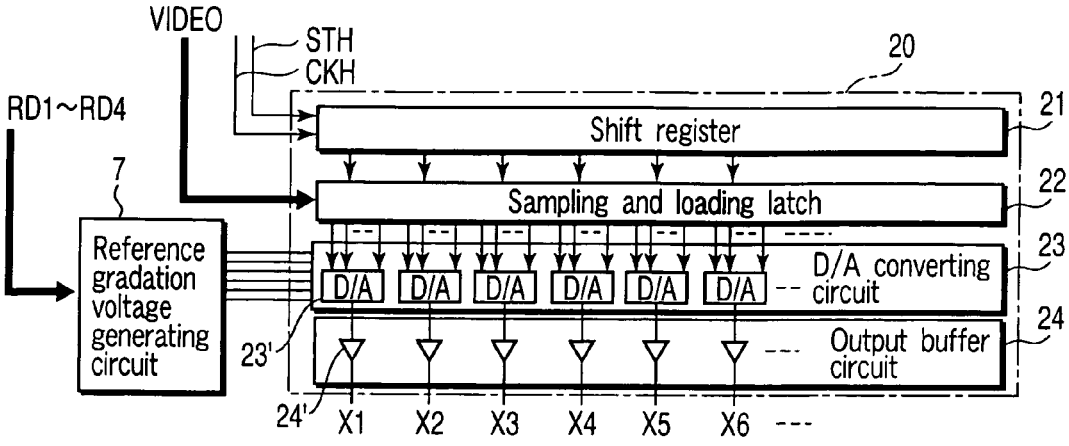
FIG. 2 schematically shows the structure of a source driver shown in FIG. 1.

FIG. 2 schematically shows the structure of the source driver 20 shown in FIG. 1. The source driver 20 includes a shift register that shifts the horizontal start signal STH in synchronism with the horizontal clock signal CKH to control the timing of serial-parallel conversion for the digital video signal VIDEO; a sampling and loading latch 22 that sequentially latches the digital video signal VIDEO under the control of the shift register 21 as display signals to be output in parallel for one row of the pixels PX; a digital-analog (D/A) converting circuit 23 that converts the display signals to analog pixel voltages; and an output buffer circuit 24 that amplifies the analog pixel voltages obtained from the D/A converting circuit 23. The D/A converting circuit 23 is configured to refer to the first predetermined number of reference gradation voltages VREF (specifically, reference gradation voltages V0 to V9) generated from the reference gradation voltage generating circuit 7.

The D/A converting circuit 23 comprises a plurality of D/A converting sections 23' that are known as resistor DACs, for instance, and a plurality of input resistor groups that output a predetermined number of gradation voltages on the basis of the reference gradation voltages. Each D/A converting section 23' selects one of the predetermined number of gradation voltages in accordance with the digital display signal output from the sampling and loading latch 22, thereby converting the display signals to analog pixel voltages. The output buffer circuit 24 comprises a plurality of buffer amplifiers 24' that amplify the analog pixel voltages from the D/A converting sections 23' and output the amplified voltages as pixel voltages to the source lines X1, X2, X3, . . . .

In the liquid crystal display device 1, the gate driver 10 outputs a scan signal to one of the gate lines Y in each horizontal scan period. During the horizontal scanning period, the source driver 20 converts display signals for one row of the pixels PX, which are included in the digital video signals, to pixel voltages to be supplied to the source lines X1 to Xn. The pixel voltages on the source lines X1 to Xn are supplied to the associated pixel electrodes PE via the pixel switching elements W of one row that are driven by the scan signal. The common voltage Vcom is output to the common electrode CE from the common voltage generating circuit 6 in synchronism with the output timing of the pixel voltages. The common voltage generating circuit 6 is constructed using, e.g. a D/A converter that generates an output voltage corresponding to numeral data of, e.g. about 8 to 10 bits, which is set by the controller 5. The common voltage generating circuit 6 alternately generates, e.g. a voltage of 0 V and a voltage of 5.8 V, each of which are output for one horizontal scan period. Thus, on the source driver 20 side, each D/A converting section 23' is configured to level-invert the pixel voltage with respect to the center level of the common voltage Vcom. In the case where the liquid crystal application voltage is maximized, the pixel voltage is set at 5.8 V relative to the common voltage Vcom of 0 V, and the pixel voltage is set at 0 V relative to the common voltage Vcom of 5.8 V. In the meantime, even if the pixel voltage of 5.8 V is output from the source driver 20, the pixel voltage decreases to, e.g. about 4.8 V, due to, e.g. a field-through voltage resulting from parasitic capacitance of the pixel switching element W, and the decreased voltage is stored in the pixel electrode PE. This being the case, the amplitude and center level of the common voltage Vcom, which is output from the common voltage generating circuit 6, is tuned in advance in accordance with the pixel voltage that is actually stored in the pixel electrode PE.

Figure 3:
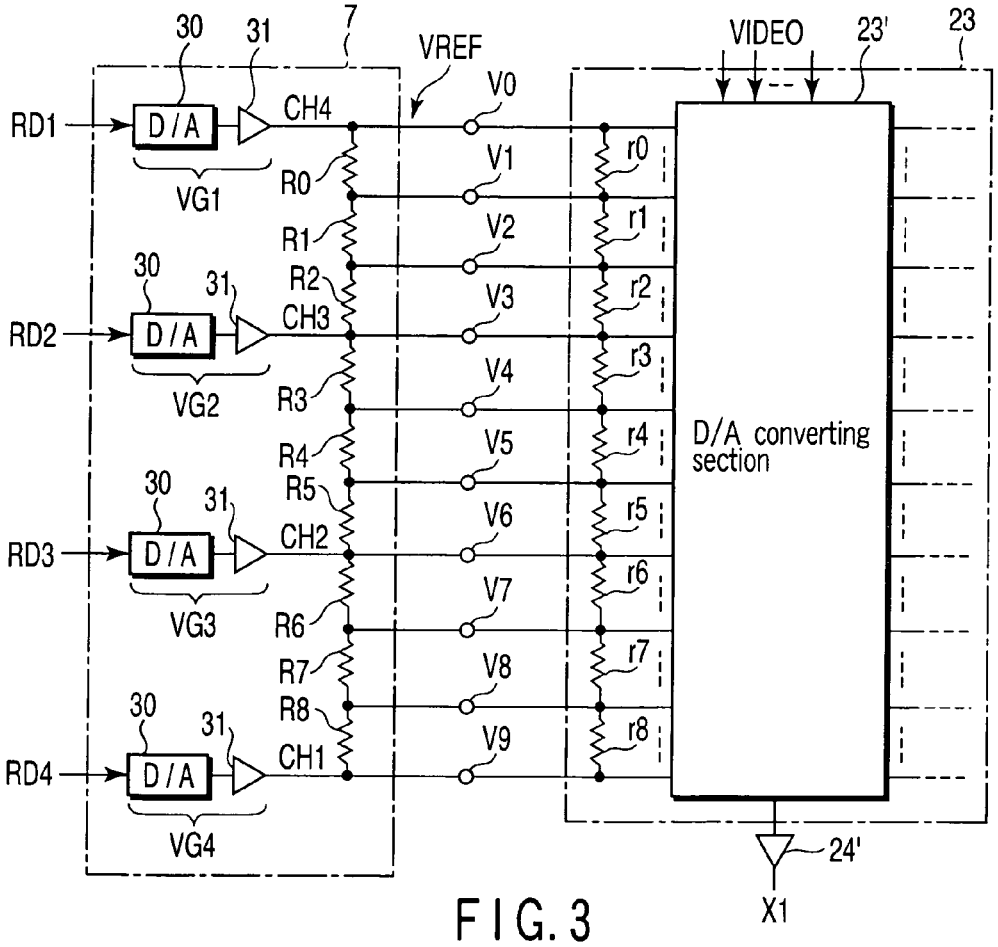
FIG. 3 shows the structure of a reference gradation voltage generating circuit shown in FIG. 2.

FIG. 3 shows the structure of the reference gradation voltage generating circuit 7 shown in FIG. 2. The reference gradation voltage generating circuit 7 includes a second predetermined number (e.g. 4) of variable voltage generating sections VG1 to VG4, which is smaller than the number of reference gradation voltages V0 to V9; and a plurality of resistors R0 to R8 that are connected in series between output terminals (output channels) CH4 to CH1 of the variable voltage generating sections VG1 to VG4. The resistors R0 to R8 divide difference voltages obtained between the output channels CH4 to CH1 of the variable voltage generating sections VG1 to VG4, thereby obtaining reference gradation voltages V0 to V9. Each of the variable voltage generating sections VG1 to VG4 includes a D/A converter 30 and an output buffer 31. In the variable voltage generating section VG1, the D/A converter 30 generates an output voltage corresponding to numeral data RD1 that is set in consideration of gamma correction, and the output buffer 31 outputs the output voltage from the output terminal CH4. In the variable voltage generating section VG2, the D/A converter 30 generates an output voltage corresponding to numeral data RD2 that is set in consideration of gamma correction, and the output buffer 31 outputs the output voltage from the output terminal CH3. In the variable voltage generating section VG3, the D/A converter 30 generates an output voltage corresponding to numeral data RD3 that is set in consideration of gamma correction, and the output buffer 31 outputs the output voltage from the output terminal CH2. In the variable voltage generating section VG4, the D/A converter 30 generates an output voltage corresponding to numeral data RD4 that is set in consideration of gamma correction, and the output buffer 31 outputs the output voltage from the output terminal CH1. The numeral data RD1 to RD4 are output, for example, from the controller 5 to the reference gradation voltage generating circuit 7 in a serial fashion. This configuration is adopted in order to reduce the number of wirings connected between the controller 5 and reference gradation voltage generating circuit 7, and to make the numeral data RD1 to RD4 variable even after the manufacture. If there is no demand for changing the numeral data RD1 to RD4 set in the manufacture, the variable voltage generating sections VG1 to VG4 may be provided with, e.g. jumper pins for setting numeral data RD1 to RD4. This is also applicable to the numeral data that is set in the common voltage generating circuit 6. The D/A converters 30 of the variable voltage generating sections VG1 to VG4 are configured to convert the numeral data RD1 to RD4 with about 8 to 10 bits to output voltages, so that a sufficiently high resolution is attainable for the 6-bit display signal.

The D/A converting circuit 23 includes input resistor groups r0, r1, r2, r3, r4, r5, r6, r7 and r8, which are connected between the output terminals of reference gradation voltages V0 and V1, between the output terminals of reference gradation voltages V1 and V2, between the output terminals of reference gradation voltages V2 and V3, between the output terminals of reference gradation voltages V3 and V4, between the output terminals of reference gradation voltages V4 and V5, between the output terminals of reference gradation voltages V5 and V6, between the output terminals of reference gradation voltages V6 and V7, between the output terminals of reference gradation voltages V7 and V8 and between the output terminals of reference gradation voltages V8 and V9, respectively. Each of the input resistor groups r0 to r8 includes a plurality of resistors, and divides the associated reference gradation voltage into voltages which are output to the D/A converting section 23' as gradation voltages.

Figure 4:
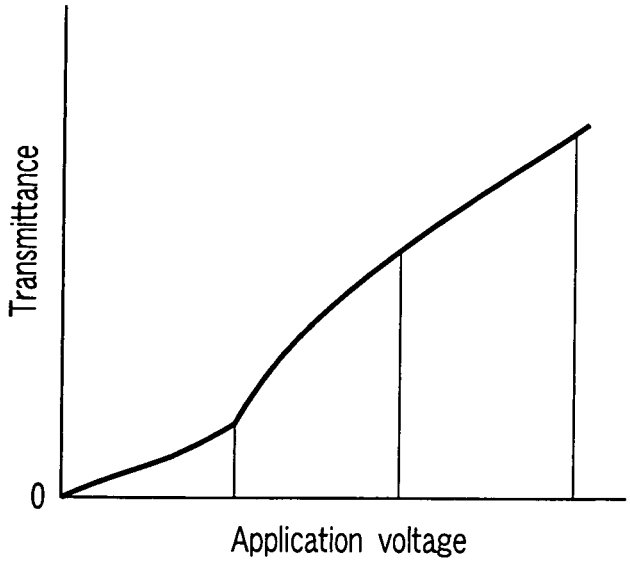
FIG. 4 is a graph that shows the transmittance characteristic of the pixel relative to the liquid crystal application voltage in a display panel shown in FIG. 1.
Figure 5:
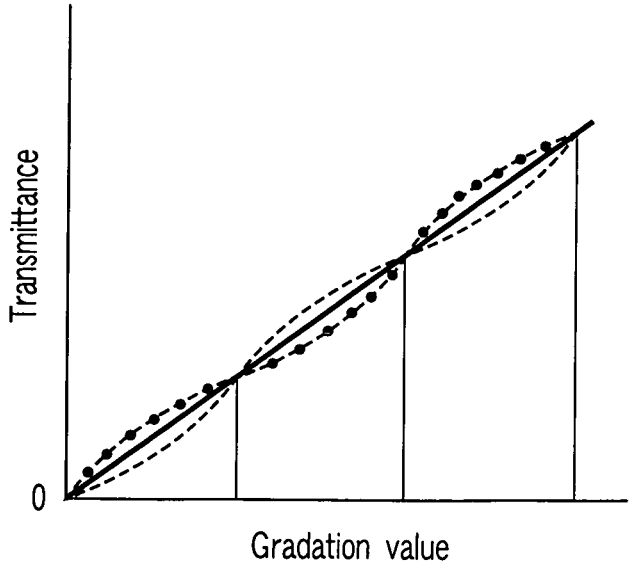
FIG. 5 is a graph that shows the transmittance characteristic of the pixel relative to the gradation value of a display signal in the display panel shown in FIG. 1.

FIG. 4 is a graph that shows the transmittance characteristic of the pixel PX relative to the liquid crystal application voltage. FIG. 5 is a graph that shows the transmittance characteristic of the pixel PX relative to the gradation value of the display signal. In the case where the pixel PX has the transmittance characteristic shown in FIG. 4, the transmittance characteristic of the pixel PX relative to the gradation value of the display signal takes a broken-line curve shown in FIG. 5. Thus, the output voltages of the variable voltage generating sections VG1 to VG4 and the resistance ratio of the resistors R0 to R8 are set in consideration of inflection points of the characteristic curve shown in FIG. 4. Thereby, gamma correction as indicated by a dot-and-dash line curve in FIG. 5 is executed in the D/A conversion of the display signal. As a result, the transmittance characteristic of the pixel is expressed as a linear line in which the transmittance is proportional to the gradation value of the display signal. In addition, since the output voltages of the variable voltage generating sections VG1 to VG4 are arbitrarily variable by the numeral data RD1 to RD4, the transmittance characteristic of the pixel PX may be made to take a desired curve. In the case of using, as in the present embodiment, the liquid crystal pixel PX that requires cyclical inversion of the direction of the electric field within the liquid crystal layer 4, it is important that the variable voltage generating sections VG1 to VG4 be symmetrical with respect to the resistance division point that corresponds to the center level of the pixel voltage.

In the liquid crystal display device 1 of the present embodiment, the resistors R0 to R8 are connected so as to divide the difference voltages between the output terminals of the four variable voltage generating sections VG1 to VG4 and to produce ten reference gradation voltages V0 to V9. In other words, the number of variable voltage generating sections VG1 to VG4, which require high resolution for gamma correction, can be made less than the number of reference gradation voltages V0 to V9. Therefore, the display signals can be converted to gamma-corrected pixel voltages, without considerably increasing manufacturing cost.

Figure 6:
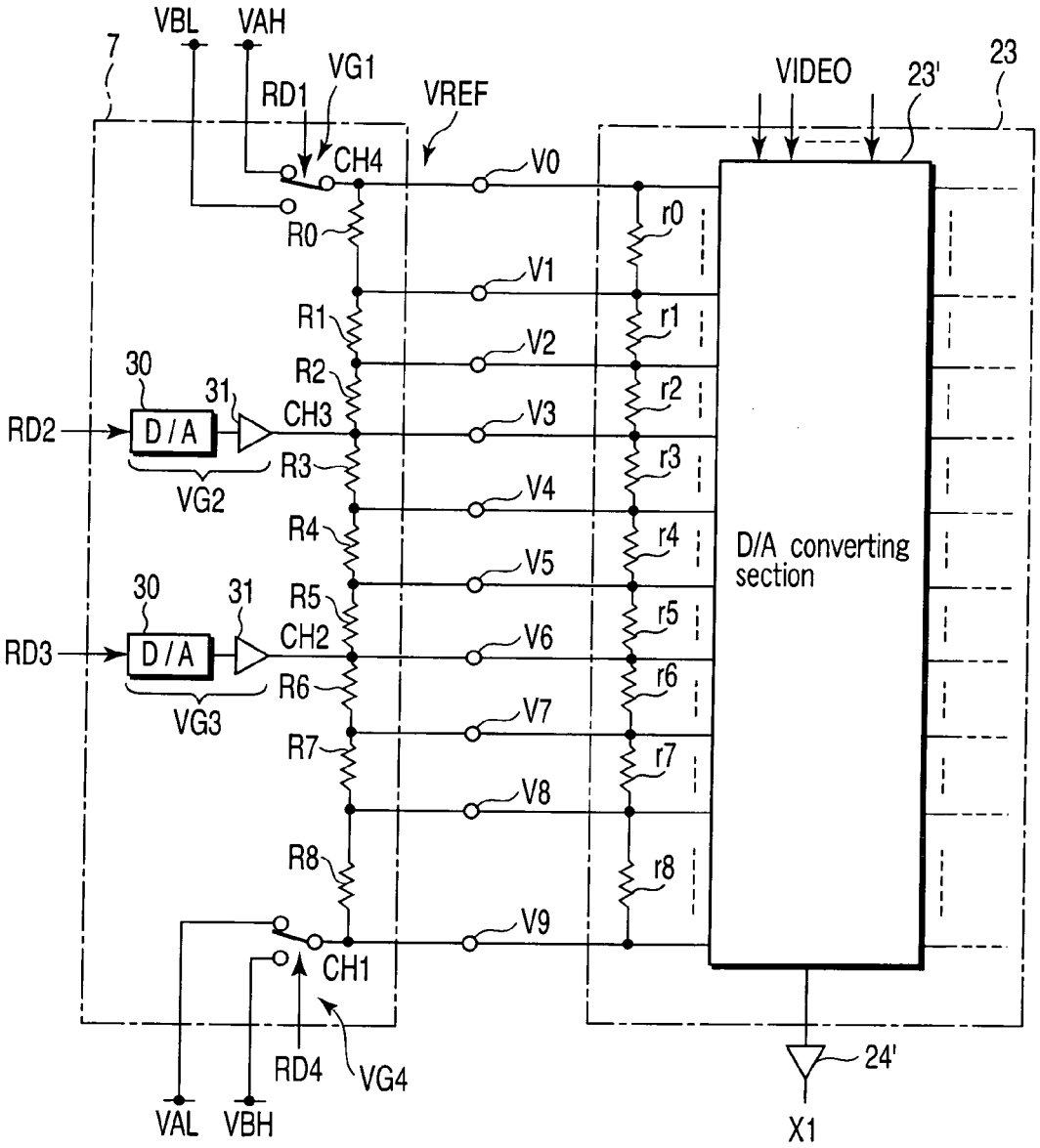
FIG. 6 shows a first modification of the reference gradation voltage generating circuit shown in FIG. 3.

FIG. 6 shows a first modification of the reference gradation voltage generating circuit 7 shown in FIG. 3. In this modification, the reference gradation voltage generating circuit 7 includes two change-over switches as variable voltage generating sections VG1 and VG4, which are disposed on the outermost sides of the series-connected resistors R0 to R8. Specifically, the variable voltage generating section VG1 is a change-over switch that outputs one of power source voltages VAH and VBL, and the variable voltage generating section VG4 is a change-over switch that outputs one of power source voltages VAL and VBH. The change-over switches of the variable voltage generating sections VG1 and VG4 are controlled by the numeral data RD1 and RD4 from the controller 5, and execute switching operations so as to alternate the pair of voltages VAH and VAL and the pair of voltages VBH and VBL for each horizontal scan period (1H). Consequently, the numeral data RD1 and RD4 are subjected to simple D/A conversion by the change-over switches. The voltages VAH and VAL are a maximum reference gradation voltage and a minimum reference gradation voltage at a time the liquid crystal application voltage has a positive polarity, and the voltages VBH and VBL are a maximum reference gradation voltage and a minimum reference gradation voltage at a time the liquid crystal application voltage has a negative polarity. The variable voltage generating sections VG2 and VG3 are disposed on the inner side of the variable voltage generating sections VG1 and VG4, while maintaining symmetry with respect to the resistance division point that corresponds to the center level of the pixel voltage.

In the first modification, since change-over switches are used as the variable voltage generating sections VG1 and VG4, the total number of D/A converters 30, which are a factor of a considerable increase in manufacturing cost, can be reduced to two, while the number of output terminals (channels) of variable output voltages remains four. In short, fine gamma correction is executable while the manufacturing cost is kept low.

Figure 7:
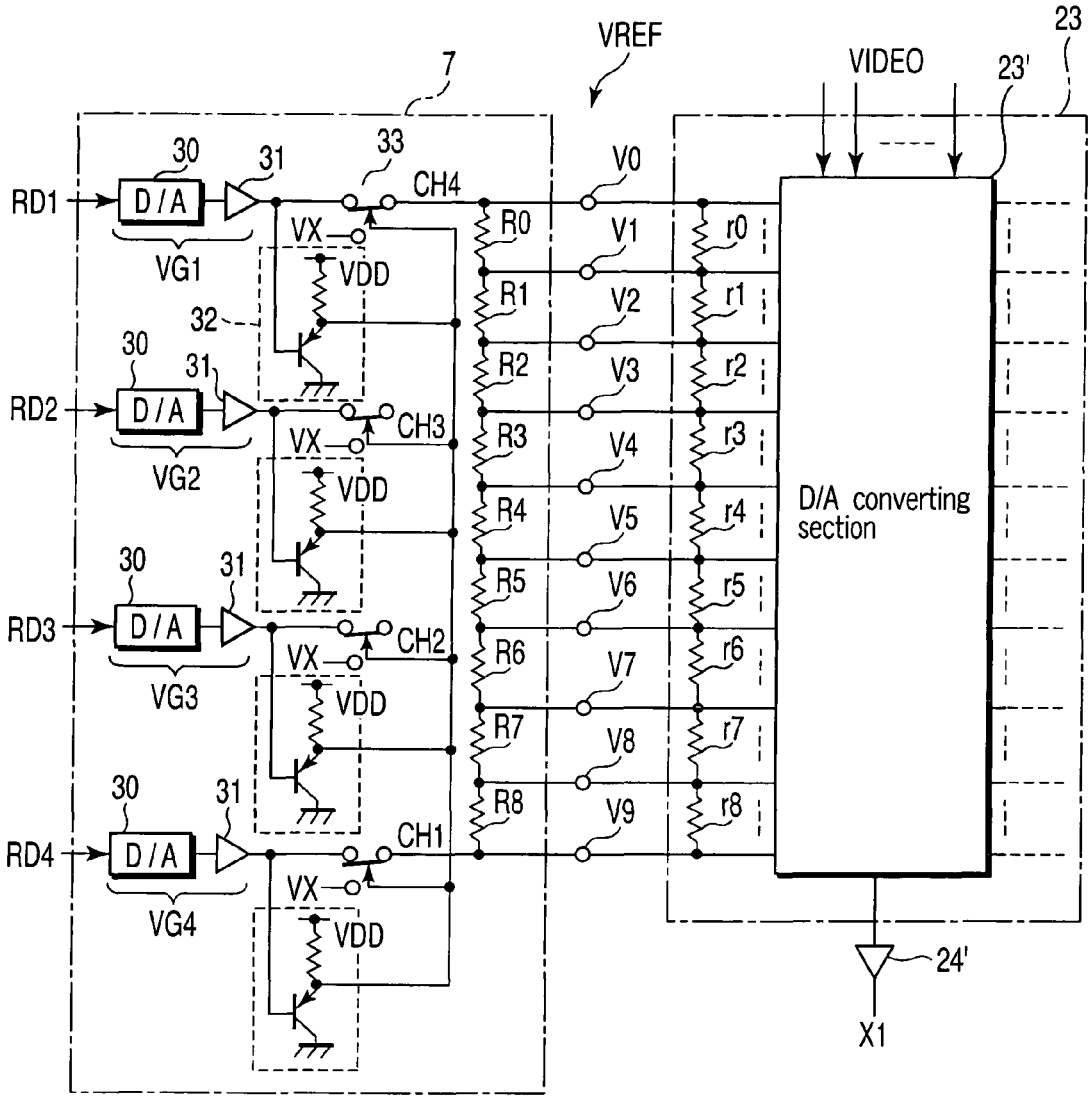
FIG. 7 shows a second modification of the reference gradation voltage generating circuit shown in FIG. 3.

FIG. 7 shows a second modification of the reference gradation voltage generating circuit 7 shown in FIG. 3. In this modification, the reference gradation voltage generating circuit 7 further includes a protection circuit for the source driver 20. The protection circuit comprises four abnormal voltage detectors 32 and four change-over switches 33. The four abnormal voltage detectors 32 are connected to the output buffers 31 of the variable voltage generating sections VG1 to VG4. In response to a detection signal that is generated from any one of the abnormal voltage detectors 32, the change-over switches 33 disconnect the output terminals CH1 to CH4 from the output buffers 31 and connect the output terminals CH1 to CH4 to power terminals that supply a specified voltage VX.

In the second embodiment, when an abnormal voltage occurs in any one of the variable voltage generating sections VG1 to VG4, the abnormal voltage is detected by an associated one of the four abnormal voltage detectors 32. As a result, the specified voltage VX is output from all the output terminals CH1 to CH4. Therefore, it is possible to avoid such a situation that the source driver 20 is destroyed by abnormal voltage that is output from the reference gradation voltage generating circuit 7 side.

Figure 8:
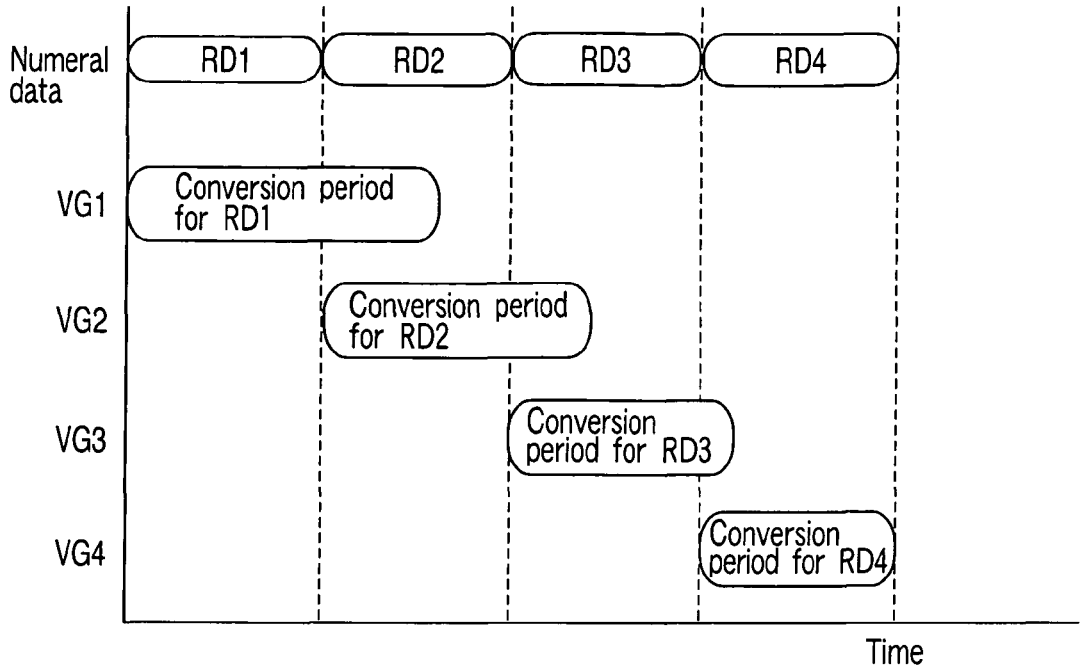
FIG. 8 illustrates the operation of a first modification of the controller shown in FIG. 1.
Figure 9:
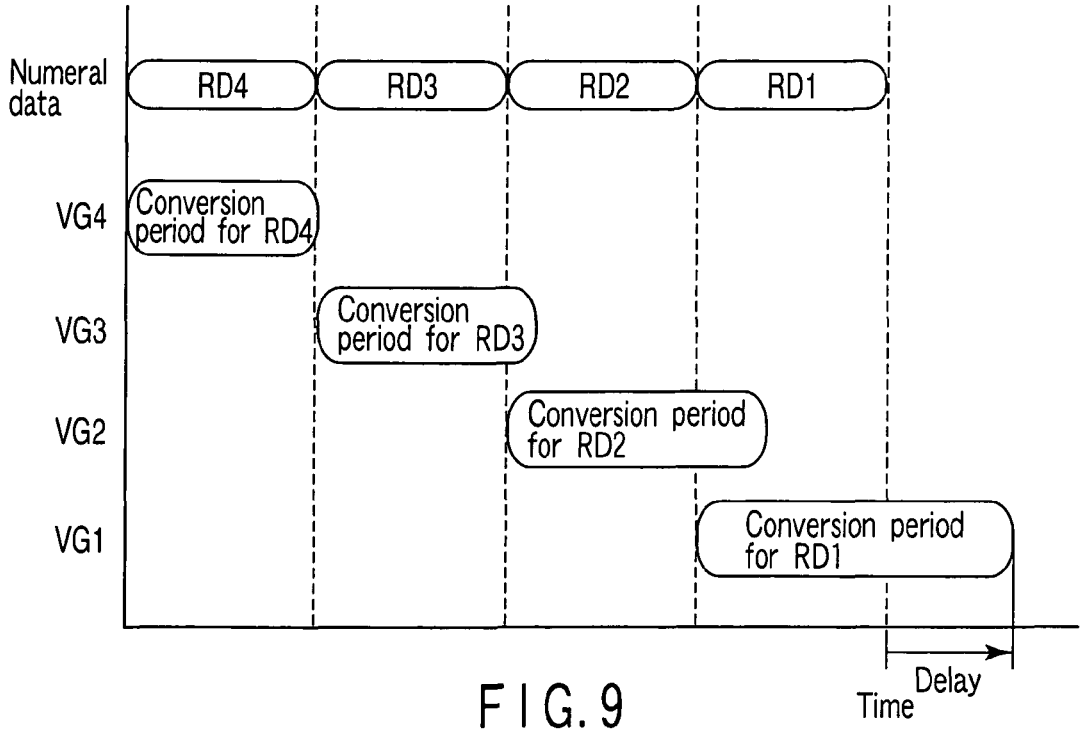
FIG. 9 illustrates a comparative example, as compared to the operation of the first modification illustrated in FIG. 8.

FIG. 8 illustrates the operation of a first modification of the controller 5 shown in FIG. 1. In this modification, the controller 5 is configured to output the numeral data RD1 to RD4 to the reference gradation voltage generating circuit 7 in a specified order. As is shown in FIG. 8, the D/A conversion periods for the numeral data RD1 to RD4 are different from each other. In a certain frame, the potential of the output terminal CH4 of the variable voltage generating section VG1 transitions to a greatest degree by the D/A conversion of the numeral data RD1, and the potential of the output terminal CH1 of the variable voltage generating section VG4 transitions to a least degree by the D/A conversion of the numeral data RD4. Thus, the controller 5 outputs to the reference gradation voltage generating circuit 7 the numeral data in an order of RD1, RD2, RD3 and RD4, from the one with the longest D/A conversion period, that is, from the one with the greatest variation amount in output potential. For example, to the reference gradation voltage generating circuit 7 shown in FIG. 3, the numeral data RD1 to RD4 are output in an order of RD1→RD2→RD3→RD4 in a certain frame, and are output in a reverse order of RD4→RD3→RD2→RD1 in the next frame. (On the other hand, in the case of the reference gradation voltage generating circuit 7 shown in FIG. 6, the numeral data RD1 to RD4 may be output in an order of RD1→RD2, RD4→RD3 in a certain frame, and may also be output in the same order in the next frame.) If the controller 5 outputs to the reference gradation voltage generating circuit 7 the numeral data in an order of RD4, RD3, RD2 and RD1, from the one with the shortest D/A conversion period, as shown in FIG. 9, the total D/A conversion period would become longer than that in the case of the order illustrated in FIG. 8.

For the above-described reason, in the first modification of the controller 5, it is possible to reduce a time loss occurring in the D/A conversion executed on the side of the reference gradation voltage generating circuit 7.

Figure 10:
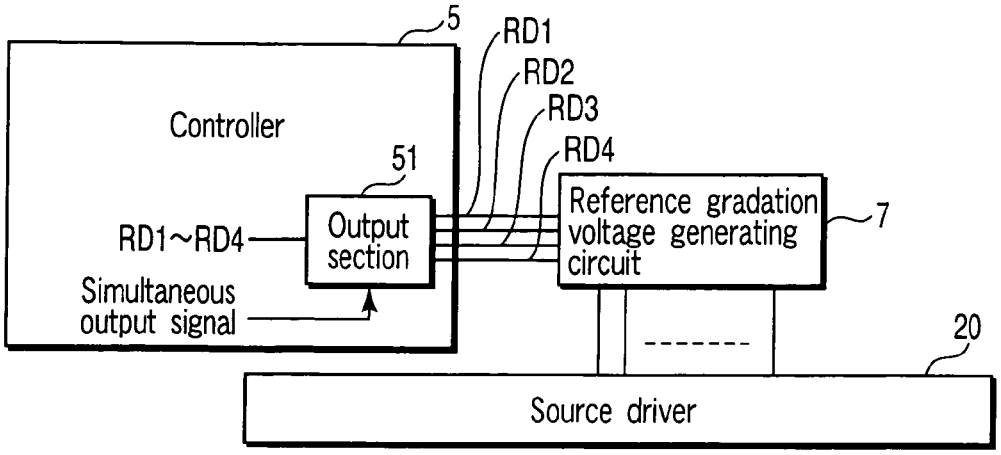
FIG. 10 illustrates a second modification of the controller shown in FIG. 1.

FIG. 10 shows a second modification of the controller 5 shown in FIG. 1. In this modification, the controller 5 includes an output section 51 that outputs numeral data RD1 to RD4 in parallel to the reference gradation voltage generating circuit 7 in response to a simultaneous output signal that is generated within the controller 5.

Figure 11:
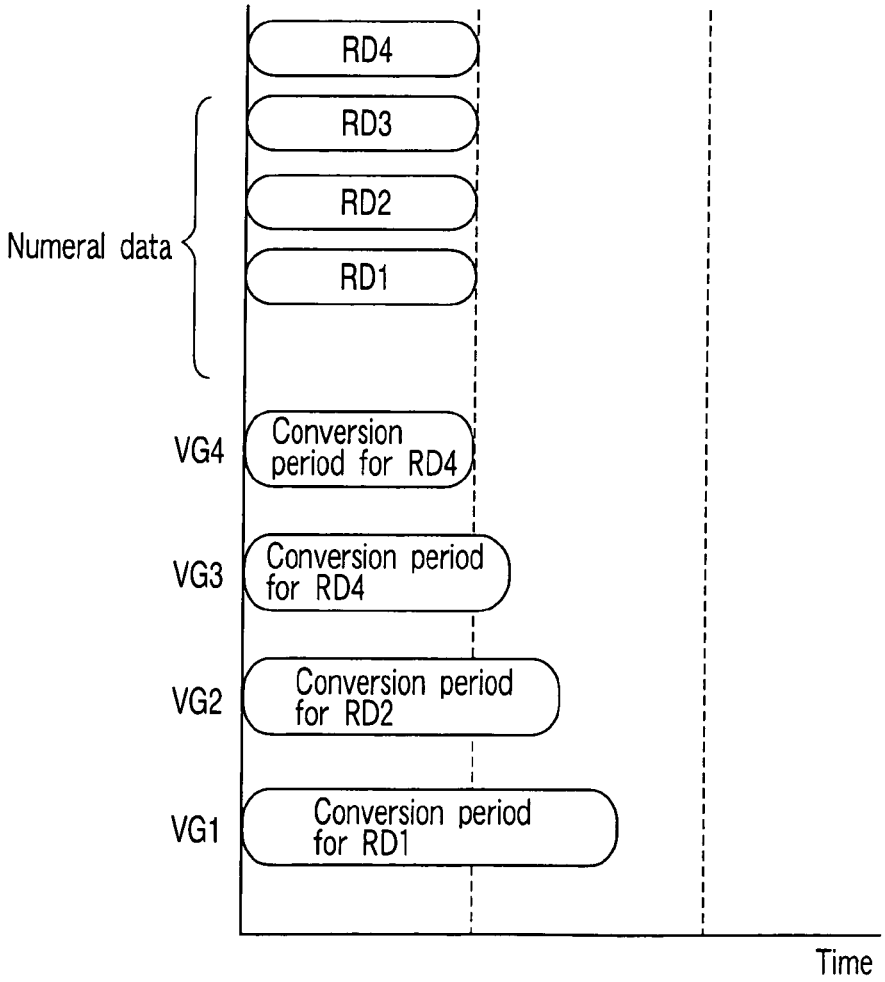
FIG. 11 illustrates the operation of the second modification shown in FIG. 10.

In this modification of controller 5, as shown in FIG. 11, the total D/A conversion period can remarkably be reduced, compared to the case where a series of numeral data RD1 to RD4 is output. Further, power, which is consumed during D/A conversion of numeral data RD1 to RD4, is reduced accordingly. Moreover, it is easy to determine the timing of generating the simultaneous output signal, and it is possible to set the numeral data RD1 to RD4 in the variable voltage generating sections VG1 to VG4, with a sufficient time being secured.

Figure 12:
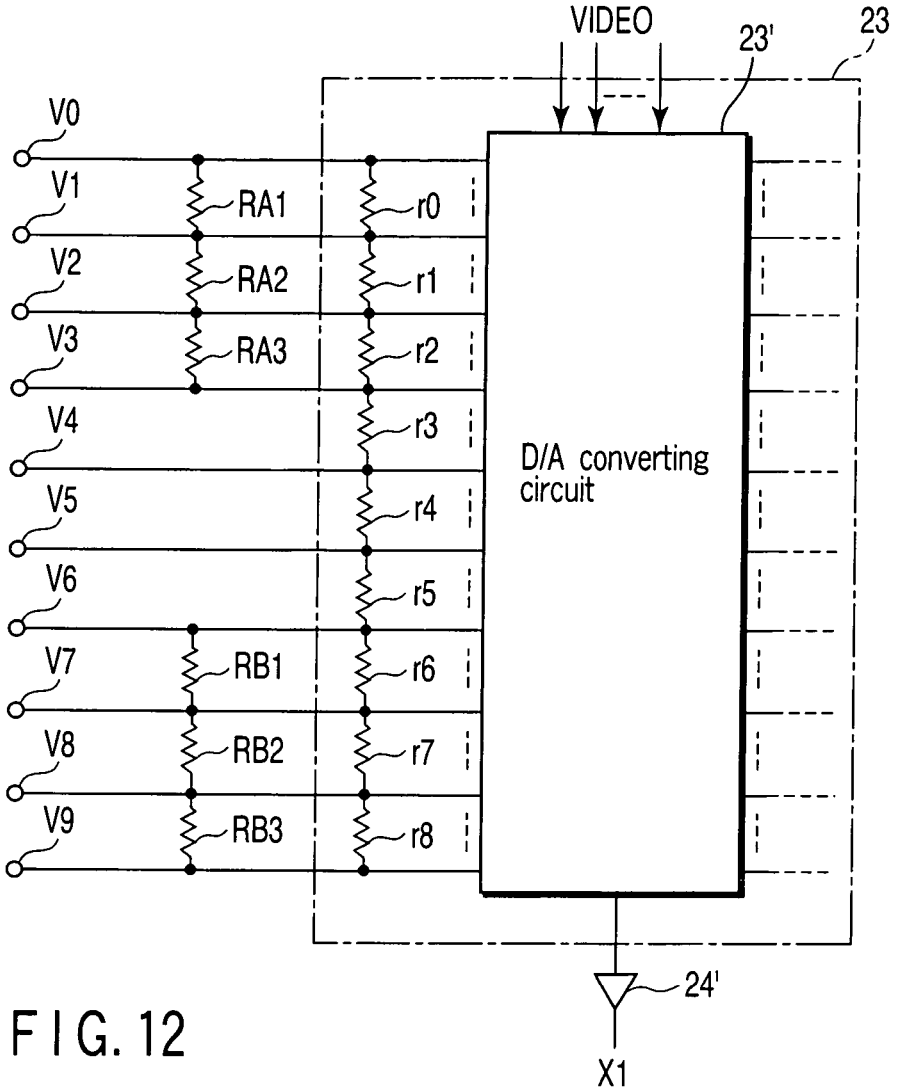
FIG. 12 shows a modification of a D/A converting circuit shown in FIG. 3.

FIG. 12 shows a modification of the D/A converting circuit 23 shown in FIG. 3. In this modification, a plurality of resistors RA1, RA2, RA3, RB1, RB2 and RB3 are provided on the outer sides of the source driver 20. The resistors RA1, RA2 and RA3 are connected in parallel to the input resistor groups r0, r1 and r2 in the D/A converting circuit 23, and the resistors RB1, RB2 and RB3 are connected in parallel to the input resistor groups r6, r7 and r8 in the D/A converting circuit 23. In this case, the voltage ratios of the voltages V0-V1 and V8-V9 to the total voltage can be reduced on the basis of the ratio of the combined resistances of the resistors RA1 to RA3, resistors RB1 to RB3 and input resistor groups r0 to r8.

Figure 13:
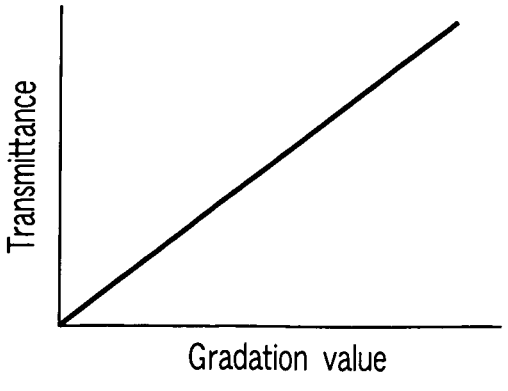
FIG. 13 is a graph illustrating a first comparative example for explaining the modification shown in FIG. 12.
Figure 14:
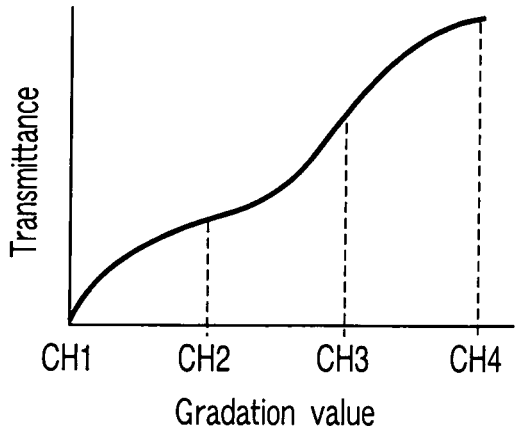
FIG. 14 is a graph illustrating a second comparative example for explaining the modification shown in FIG. 12.
Figure 15:
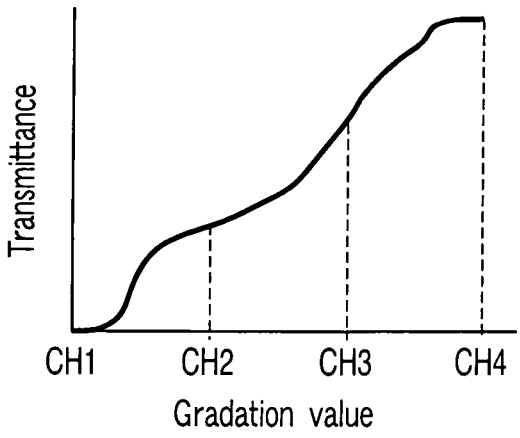
FIG. 15 is a graph showing the characteristic of the modification shown in FIG. 12.

This modification eliminates a difference in the luminance to be obtained with respect to blackish gradations for the vicinity of the minimum luminance and whitish gradations for the vicinity of the maximum luminance to cope with gradation errors that tend to occur in the vicinity of the minimum luminance and in the vicinity of the maximum luminance, and to enhance the resolution for the luminance to be obtained with respect to intermediate gradations between the blackish and whitish gradations. For example, when voltages V0 and V9 are only applied from the output terminals CH4 and CH1, the transmittance characteristic of the pixel PX relative to the gradation value of the display signal is defined as shown in FIG. 13. With this transmittance characteristic, gamma correction is difficult. For example, when voltages V0, V3, V6 and V9 are applied from the output terminals CH4, CH3, CH2 and CH1, the transmittance characteristic of the pixel PX relative to the gradation value of the display signal is defined as shown in FIG. 14. With this transmittance characteristic, gamma correction is possible. On the other hand, with the structure shown in FIG. 12, voltages V0, V3, V6 and V9 are applied from the output terminals CH4, CH3, CH2 and CH1, but the resistors RA1 to RA3 and resistors RB1 to RB3 serve as a correction circuit for selectively correcting the reference gradation voltages V0-V1 and V8-V9 to eliminate a difference in the luminance to be obtained with respect to gradations for at least one of the vicinity of the minimum luminance and the vicinity of the maximum luminance. In this case, the transmittance characteristic of the pixel PX relative to the gradation value of the display signal is defined as shown in FIG. 15.

Figures 16, 17:
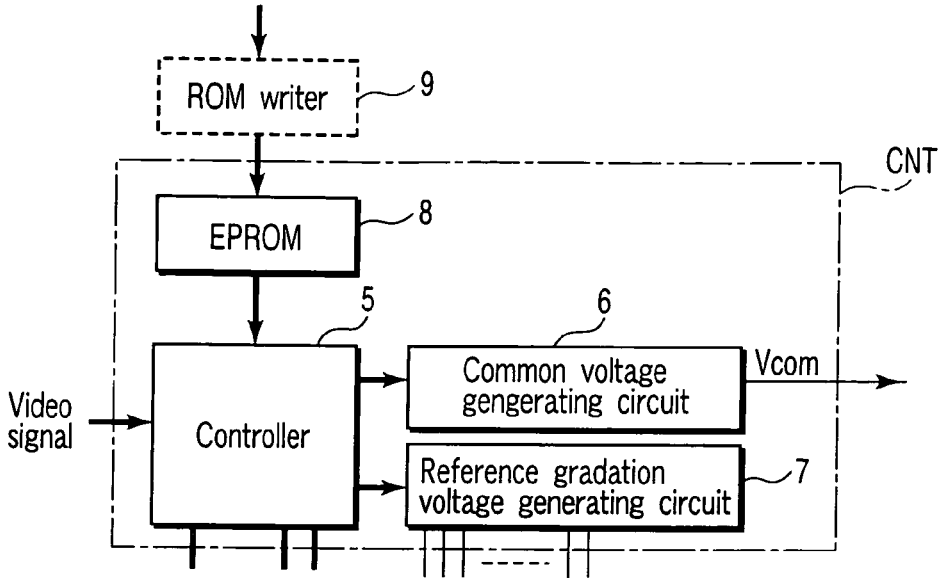
FIG. 16 shows a first modification of a control unit shown in FIG. 1.
FIG. 17 shows a gradation table that is stored in an EPROM shown in FIG. 16.

FIG. 16 shows a first modification of the control unit CNT shown in FIG. 1. In this modification, the control unit CNT further includes an EPROM 8. The EPROM 8 stores a gradation table, for instance, as shown in FIG. 17, in order to eliminate a difference in the luminance to be obtained with respect to blackish gradations for the vicinity of the minimum luminance and whitish gradations for the vicinity of the maximum luminance. The gradation table is prestored in the EPROM 8 using an external ROM writer 9. The controller 5 converts a gradation value of the display signal for each pixel PX, with the digital format being maintained, referring to the gradation table.

In the first modification of the control unit CNT, the EPROM 8 and controller 5 serve as a correction circuit that corrects the display signal to eliminate a difference in the luminance to be obtained with respect to gradations for at least one of the vicinity of the minimum luminance and the vicinity of the maximum luminance. Hence, the transmittance characteristic of the pixel PX relative to the gradation value of the display signal is defined as shown in FIG. 15. In short, the same advantageous effect as in the modification shown in FIG. 12 can be obtained.

Figure 18:
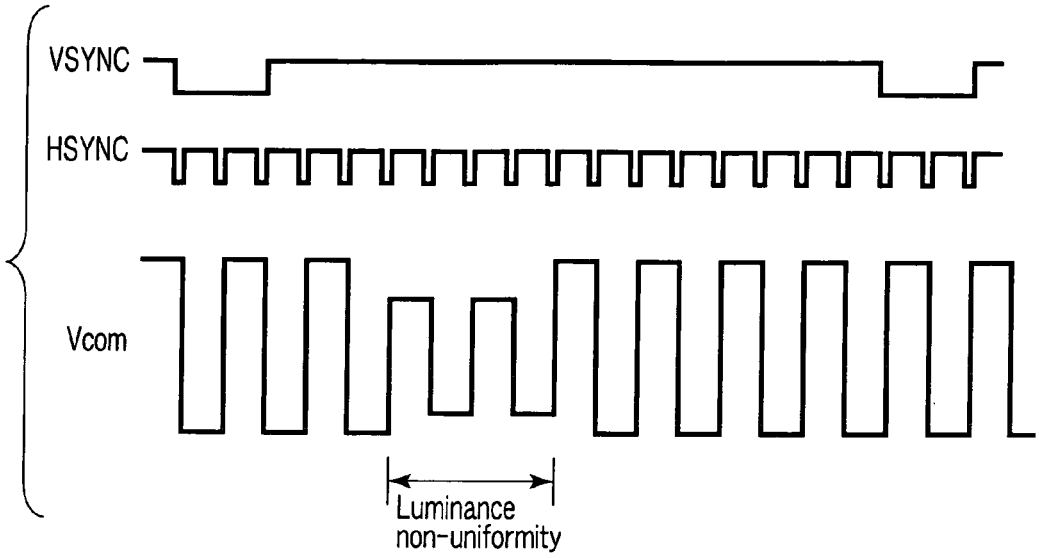
FIG. 18 illustrates the operation of a second modification of the control unit shown in FIG. 1.

FIG. 18 illustrates the operation of a second modification of the control unit CNT shown in FIG. 1. The second modification has a hardware configuration identical to that shown in FIG. 16. However, a difference exists in that the EPROM 8 stores control information for varying the amplitude of the common voltage Vcom with respect to a specified line in the display panel DP, that is, with respect to the pixels PX on a specified row. The specified line is a part of the display panel DP where non-uniformity in luminance occurs, for example. The control information may be stored in the EPROM 8 for the purpose of arbitrarily varying the luminance, regardless of luminance non-uniformity. Based on the control information stored in the EPROM 8, the controller 5 sets numeral data in the common voltage generating circuit 6 at a proper timing, and temporarily varies the amplitude of the common voltage Vcom, for example, as shown in FIG. 18. The control timing for the common voltage generating circuit 6 is determined on the basis of a vertical sync signal VSYNC and a horizontal sync signal HSYNC that are supplied from outside along with the video signal.

With this control, an improvement of image quality can be expected against degradation due to luminance non-uniformity. To enhance the improvement, the pixel voltage may be controlled together with the amplitude of the common voltage Vcom.

Figure 19:
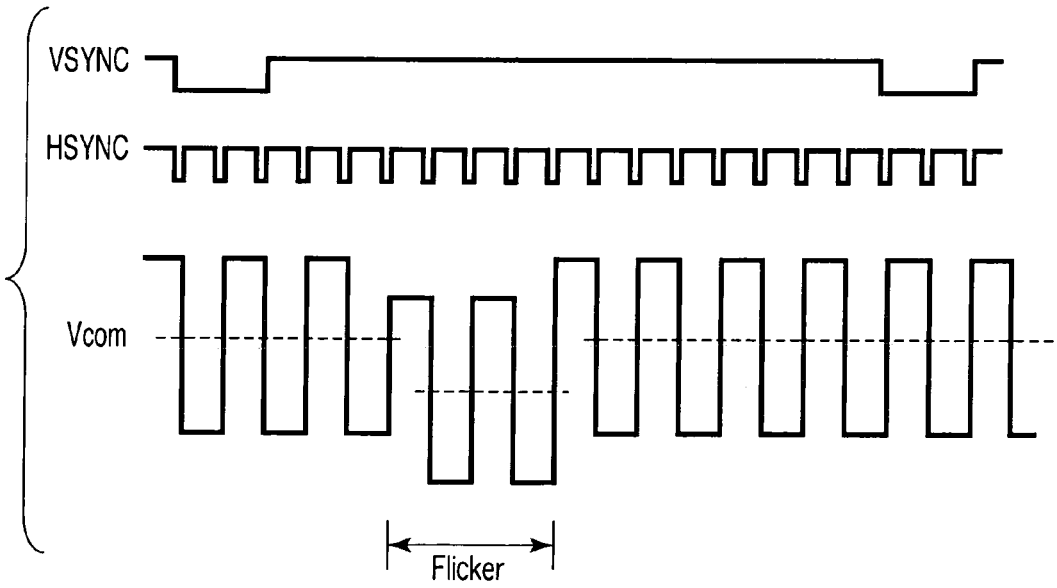
FIG. 19 illustrates the operation of a third modification of the control unit shown in FIG. 1.

FIG. 19 illustrates the operation of a third modification of the control unit CNT shown in FIG. 1. The third modification has a hardware configuration identical to that shown in FIG. 16. However, a difference exists in that the EPROM 8 stores control information for varying the center level of the common voltage Vcom with respect to a specified line in the display panel DP, that is, with respect to the pixels PX on a specified row. The specified line is a part of the display panel DP where flicker occurs, for example. Based on the control information stored in the EPROM 8, the controller 5 sets numeral data in the common voltage generating circuit 6 at a proper timing, and temporarily varies the center level of the common voltage Vcom, for example, as shown in FIG. 19. The control timing for the common voltage generating circuit 6 is determined on the basis of a vertical sync signal VSYNC and a horizontal sync signal HSYNC that are supplied from outside along with the video signal.

With this control, an improvement of image quality can be expected against degradation due to flicker. To enhance the improvement, the pixel voltage may be controlled together with the amplitude of the common voltage Vcom.

Figure 20:
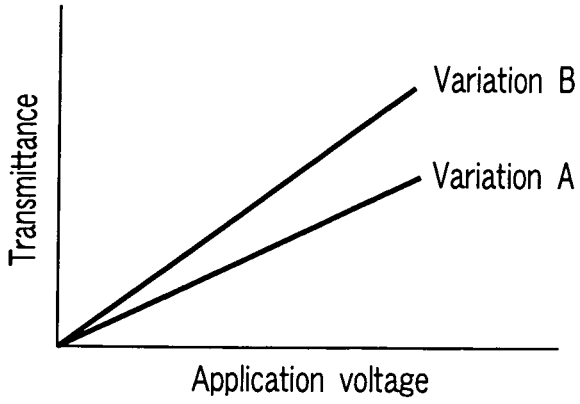
FIG. 20 is a graph that shows a variation in the transmittance characteristic, which occurs in the display panel shown in FIG. 1.

The transmittance characteristic of the pixel PX relative to the liquid crystal application voltage varies from pixel PX to pixel PX, as shown in FIG. 20, due to the influence of, e.g. a backlight.

Figure 21:
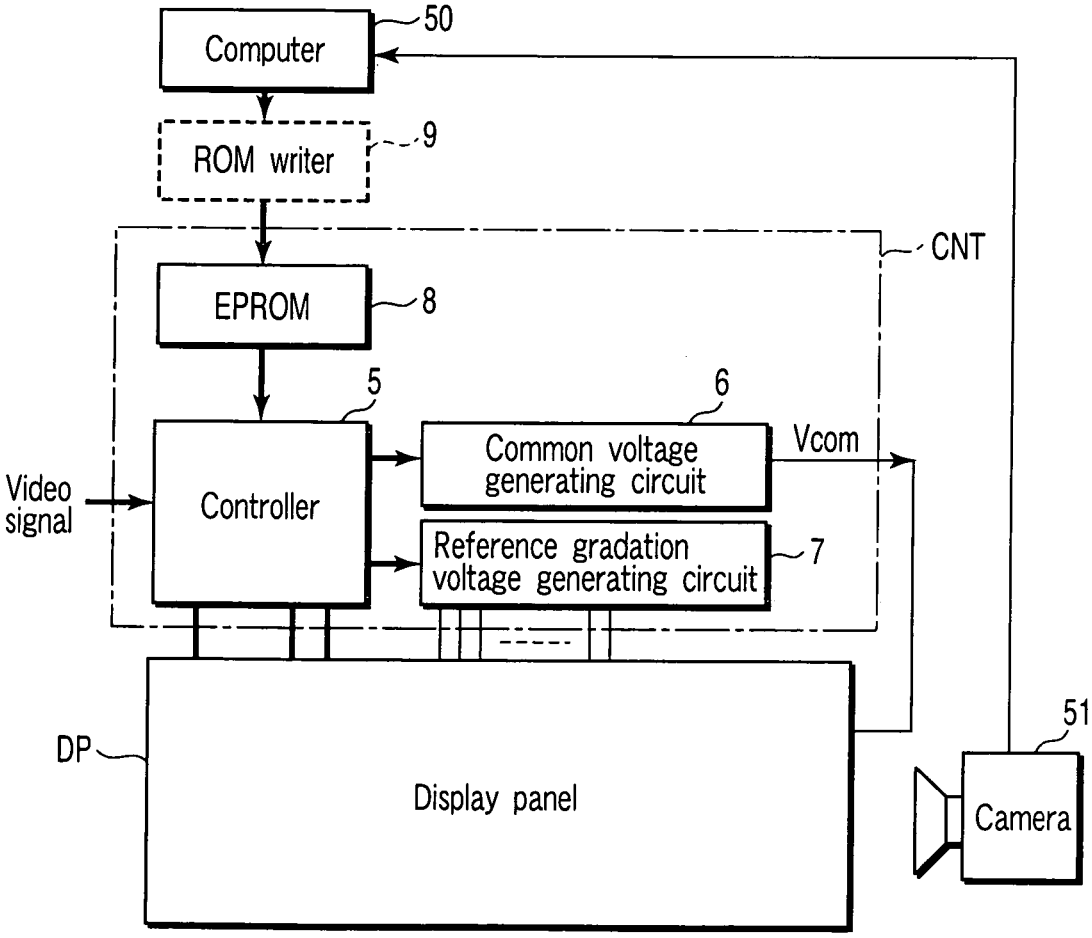
FIG. 21 shows a fourth modification of the control unit shown in FIG. 1.

FIG. 21 shows a fourth modification of the control unit CNT shown in FIG. 1. This modification has a hardware configuration identical to that shown in FIG. 16. However, a difference exists in that a camera 50 for capturing an image displayed on the display panel DP, and a computer 51 for analyzing image information obtained by the camera 50 are additionally provided. These components are used to control the ROM writer 9 in the manufacture. The EPROM 8 stores control information that is written by the ROM writer 9 and compensates the transmittance characteristics that vary from pixel PX to pixel PX, as shown in FIG. 20. Based on the control information, the controller 5 controls the amplitudes of the pixel voltage and common voltage Vcom with respect to a specified position in the display panel DP, that is, a specified pixel PX.

In this modification, variations in the transmittance characteristics of the pixels PX can be reduced.

When the display panel DP is viewed in an inclined direction, inversion and non-uniformity in the luminance of an image occurs. As a countermeasure against this problem, a gradation table for gradually varying the liquid crystal application voltage from row to row of pixels PX may be set in the EPROM 8, so that the controller 5 can converts a gradation value of each display signal with reference to the gradation table.

Regarding the case where the power supply of the liquid crystal display device 1 is to be turned off, the controller 5 may be configured to set, in advance, the reference gradation voltages V0 to V9, which are output from the reference gradation voltage generating circuit 7, at an identical level determined arbitrarily, by using the change-over switches 33 shown in FIG. 7, for instance. In this case, it is preferable to also set the common voltage Vcom at the identical level. With this structure, persistence that occurs upon turn-off of power can be cancelled almost completely and quickly.

Next, a liquid crystal display device according to a second embodiment of the invention will be described. This liquid crystal display device is similar to that of the first embodiment, except for the structure corresponding to the D/A converting circuit 23 and reference gradation voltage generating circuit 7 shown in FIG. 2. Thus, the similar parts are denoted by the same reference symbols, and a detailed description thereof is omitted.

Figure 22:
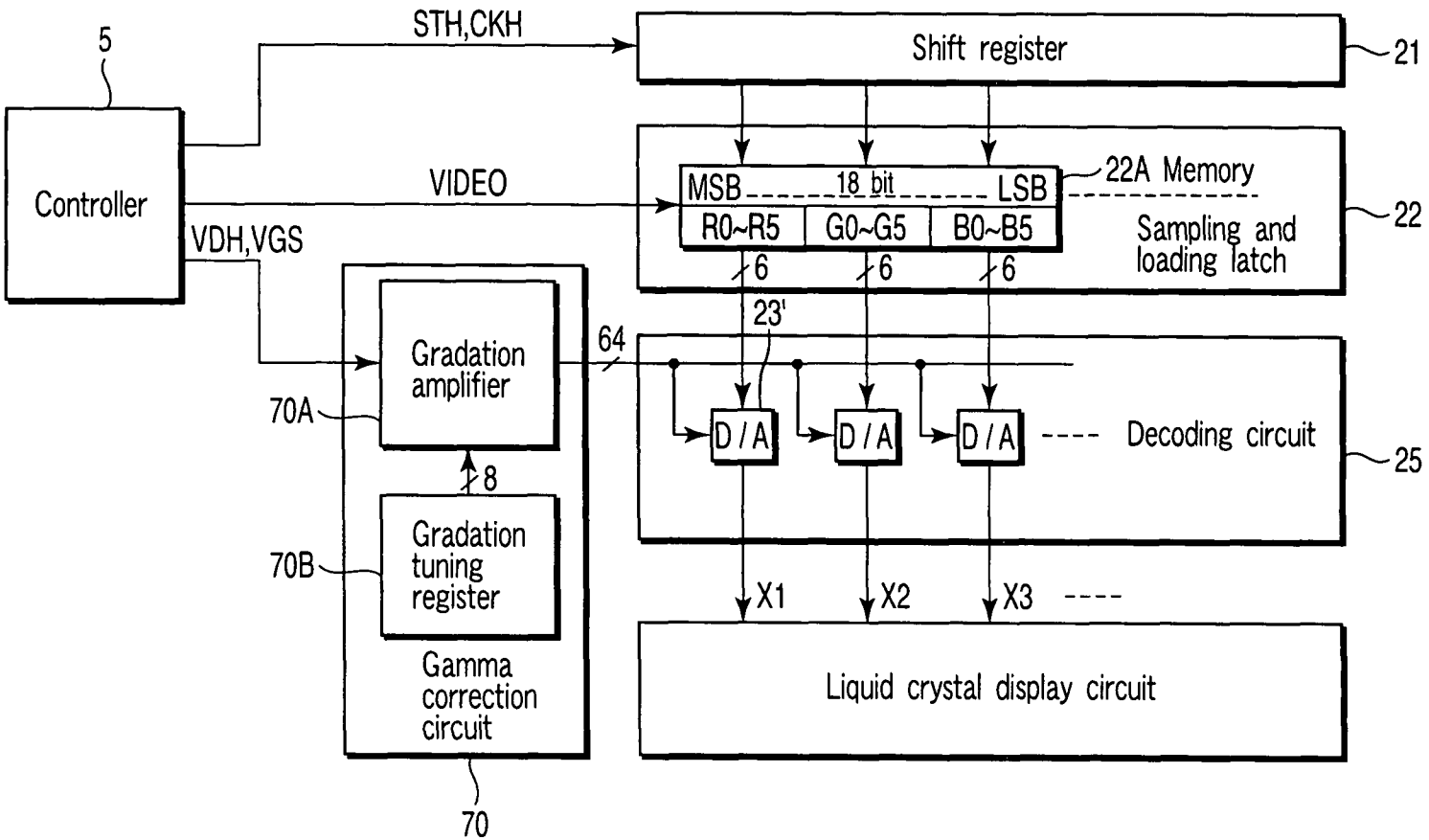
FIG. 22 is a block diagram that shows the circuit configuration of a liquid crystal display device according to a second embodiment of the invention.
Figure 23:
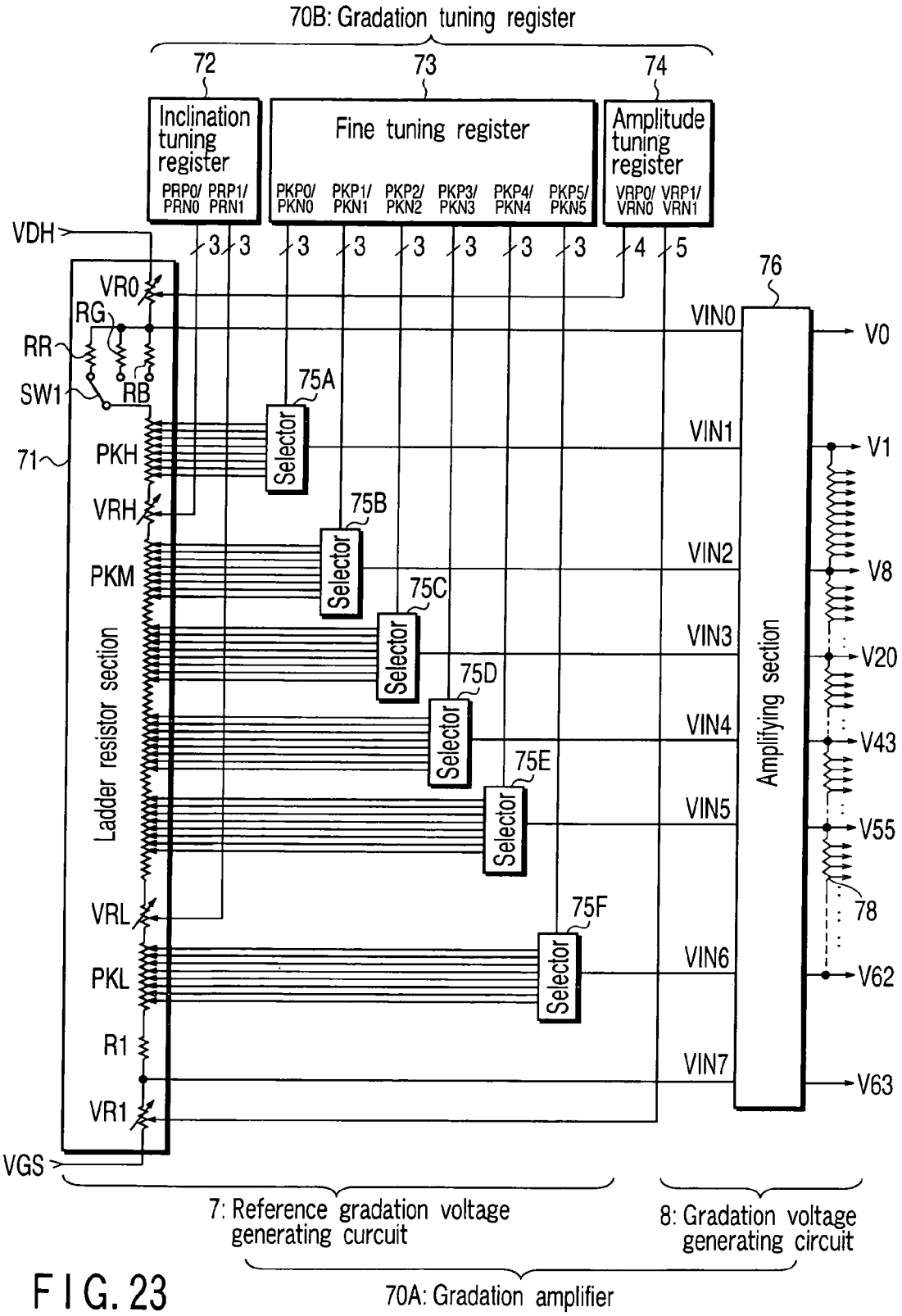
FIG. 23 is a circuit diagram that shows the structure of a gamma correction circuit shown in FIG. 22.

FIG. 22 shows the circuit configuration of the liquid crystal display device according to the second embodiment, and FIG. 23 shows the structure of a gamma correction circuit shown in FIG. 22.

In order to execute color display with 262,144 colors, the sampling and loading latch 22 is formed of memories 22A each for storing 18-bit digital data including 3 items of 6-bit data which are display signals for pixels of red, green and blue, i.e. three primary colors of light. Each of 6-bit data is used for selecting one of 64 ($=2^6$) gradations of a corresponding color. As is shown in FIG. 22, 6-bit data R0-R5 represents a gradation value of red, 6-bit data G0-G5 represents a gradation value of green, and 6-bit data B0-B5 represents a gradation value of blue.

A decoding circuit 25 comprises a plurality of D/A converting sections 23'. Each D/A converting section 23' is configured such that 64 gradation values which are selectable by the 6-bit data read from a corresponding memory 22A are assigned to 64 gradation voltages which are output from a gamma correction circuit 70, in one-to-one correspondence. The D/A converting sections 23' convert the gradation values to corresponding gradation voltages, and output the gradation voltages to the signal lines X on the liquid crystal display circuit side.

In this liquid crystal display device, the gamma correction circuit 70 includes a gradation amplifier 70A and a gradation tuning register 70B. The gradation amplifier 70A includes a reference gradation voltage generating circuit 7 and a gradation voltage generating circuit 8.

As shown in the circuit diagram of FIG. 23, the gradation amplifier 70A includes a ladder resistor section 71 and selectors 75A to 75F. The gradation voltage generating circuit 8 includes an amplifying section 76 and a ladder resistor section 78. The gradation tuning register 70B includes an inclination tuning register 72, a fine tuning register 73 and an amplitude tuning register 74.

The ladder resistor section 71 is supplied with a reference voltage determined by an upper limit voltage VDH and a lower limit voltage VGS. The ladder resistor section 71 includes a plurality of resistors for dividing the reference voltage into a plurality of voltages and executing gamma correction. Specifically, a variable resistor VR0, a resistor PKH, a variable resistor VRH, a resistor PKM, a variable resistor VRL, a resistor PKL, a resistor R1 and a variable resistor VR1 are connected in series in the named order. In addition, resistors RR, RG and RB are connected in parallel between the variable resistor VR0 and resistor PKH so as to be switchable by a switch SW1.

The variable resistors VR0 and VR1 are provided for amplitude tuning of gradation voltages. A switching control for the resistors RR, RG and RB is executed by the controller 5. The resistor RR is used for gamma correction of red, the resistor RG is used for gamma correction of green, and the resistor RB is used for gamma correction of blue. The resistances of the resistors RR, RG and RB are preset at values that are suited to gamma correction of the respective colors.

The resistors PKH, PKM and PKL are used for fine-tuning the magnitude of the gradation voltage in association with the gradation value. The variable resistors VRH and VRL are used for tuning the inclination of the characteristic curve that represents the characteristics of the gradation voltage in association with the gradation value.

The inclination tuning register 72 stores items of 3-bit data for setting the resistances of the variable resistors VRH and VRL. In addition, the registers 72, 73 and 74 are provided for the positive and negative polarities so that the resistances can be independently set in accordance with the polarity of the gradation value. In a list of FIG. 24, PRP0 denotes positive polarity data for setting the resistance of the variable resistor VRH, and PRN0 denotes negative polarity data for setting the resistance of the variable resistor VRH. PRP1 denotes positive polarity data for setting the resistance of the variable resistor VRL, and PRN1 denotes negative polarity data for setting the resistance of the variable resistor VRL. By using the contents of the inclination tuning register 72 for the setting, the inclination of the characteristic curve that represents the characteristics of the gradation voltage in association with the gradation value can be tuned, as shown in FIG. 25.

Figure 26:
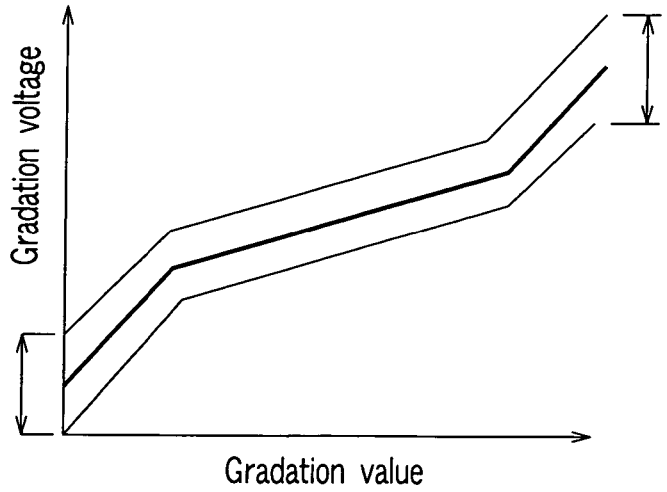
FIG. 26 is a graph that shows the gradation value-gradation voltage characteristic obtained as a result of amplitude tuning of the gradation voltage that is executed in the gamma correction circuit shown in FIG. 23.

The amplitude tuning register 74 stores items of 3-bit data for setting the resistances of the variable resistors VR0 and VR1. In the list of FIG. 24, VRP0 denotes positive polarity data for setting the resistance of the variable resistor VR0, and VRN0 denotes negative polarity data for setting the resistance of the variable resistor VR0. VRP1 denotes positive polarity data for setting the resistance of the variable resistor VR1, and VRN1 denotes negative polarity data for setting the resistance of the variable resistor VR1. By using the contents of the amplitude tuning register 74 for the setting, the amplitude of the gradation voltage can be tuned, as shown in FIG. 26.

Figure 27:
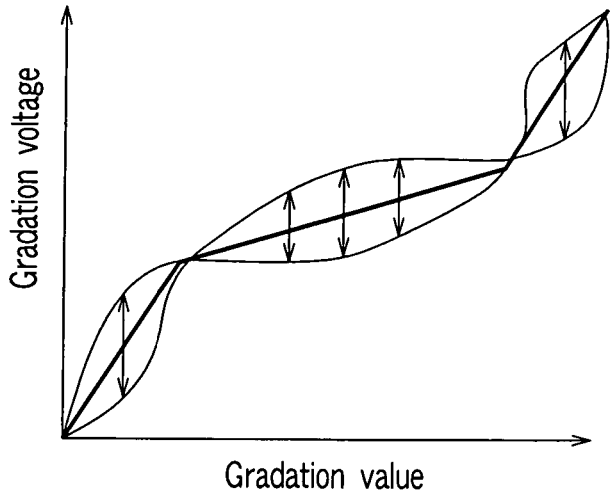
FIG. 27 is a graph that shows the gradation value-gradation voltage characteristic obtained as a result of fine tuning of the gradation voltage that is executed in the gamma correction circuit shown in FIG. 23.

The fine tuning register 73 stores items of 3-bit data for controlling 8-input/1-output selectors 75A to 75F. The selector 75A has 8 input terminals connected to the resistor PKH, and selects one of 8 division voltages in the resistor PKH, on the basis of the contents of the fine tuning register 73. The selectors 75B to 75E have their input terminals connected to the resistor PKM in succession. Each of the selectors 75B to 75E selects one of 8 division voltages in the resistor PKM, on the basis of the contents of the fine tuning register 73. The selector 75F has 8 input terminals connected to the resistor PKL, and selects one of 8 division voltages in the resistor PKL, on the basis of the contents of the fine tuning register 73. In the list of FIG. 24, PKP0 denotes positive polarity data for setting the selection by the selector 75A, and PKN0 denotes negative polarity data for setting the selection by the selector 75A. PKP1 denotes positive polarity data for setting the selection by the selector 75B, and PKN1 denotes negative polarity data for setting the selection by the selector 75B. PKP2 denotes positive polarity data for setting the selection by the selector 75C, and PKN2 denotes negative polarity data for setting the selection by the selector 75C. PKP3 denotes positive polarity data for setting the selection by the selector 75D, and PKN3 denotes negative polarity data for setting the selection by the selector 75D. PKP4 denotes positive polarity data for setting the selection by the selector 75E, and PKN4 denotes negative polarity data for setting the selection by the selector 75E. PKP5 denotes positive polarity data for setting the selection by the selector 75F, and PKN5 denotes negative polarity data for setting the selection by the selector 75F. By using the contents of the fine tuning register 73 for the setting, the magnitude of the gradation voltage in association with the gradation value can be tuned, as shown in FIG. 27.

In FIG. 23, the voltage at the output stage of the variable resistor VR0 is VIN0, the output voltage of the selector 75A is VIN1, the output voltage of the selector 75B is VIN2, the output voltage of the selector 75C is VIN3, the output voltage of the selector 75D is VIN4, the output voltage of the selector 75E is VIN5, the output voltage of the selector 75F is VIN6, and the voltage at the input stage of the variable resistor VR1 is VIN7. The selectors 75A to 75F perform selection to determine the voltages VIN1 to VIN6, respectively.

The amplifying section 76 amplifies voltages VIN0 to VIN7 and outputs the amplified voltages. The voltage VIN0 corresponds to V0 of 64-level output voltages V0 to V63 of the gamma correction circuit 70, the voltage VIN1 corresponds to V1, and the voltage VIN2 corresponds to V8. Resistors are connected between the V1 line and V8 line, and 6-level division voltages that are obtained by these resistors are output as output voltages V2 to V7 of the gamma correction circuit 70. Similarly, the voltage VIN3 corresponds to V20, and 11-level division voltages that are obtained by resistors connected between the V8 line and V20 line are output as output voltages V9 to V19 of the gamma correction circuit 70. The voltage VIN4 corresponds to V43, and 22-level division voltages that are obtained by resistors connected between the V20 line and V43 line are output as output voltages V21 to V42 of the gamma correction circuit 70. The voltage VIN5 corresponds to V55, and 11-level division voltages that are obtained by resistors connected between the V43 line and V55 line are output as output voltages V44 to V54 of the gamma correction circuit 70. The voltage VIN6 corresponds to V62, and 6-level division voltages that are obtained by resistors connected between the V55 line and V62 line are output as output voltages V56 to V61 of the gamma correction circuit 70. The voltage VIN7 corresponds to V63. In this manner, the gamma correction circuit 70 outputs voltages V0 to V63.

The voltage V0 corresponds to a black level with a minimum luminance, and the voltage V63 corresponds to a white level with a maximum luminance. The resistors RR, RG and RB, which are switched in accordance with red, green and blue, are connected between the VIN1 line and the VIN0 line for the black level.

Figure 28:
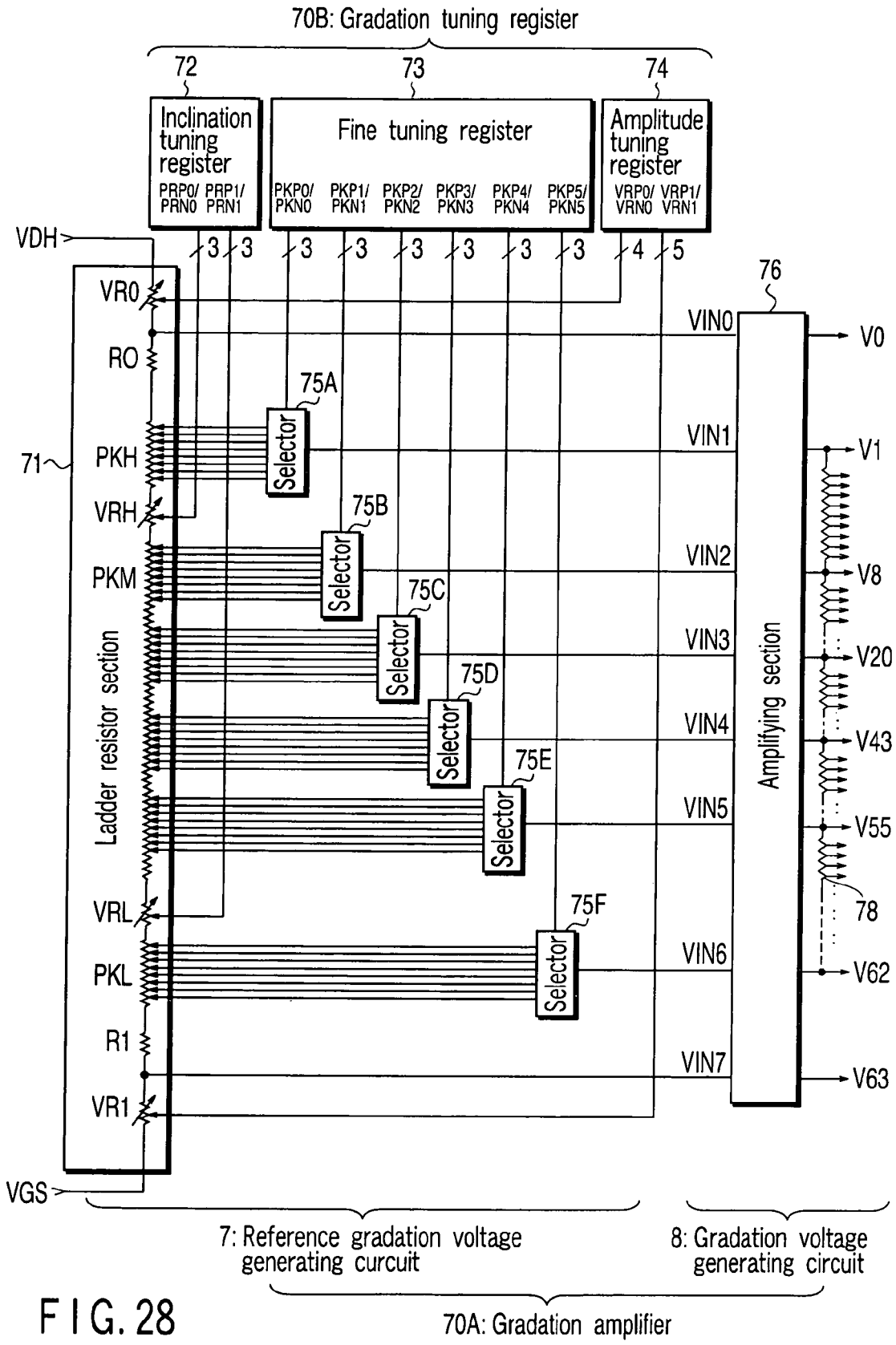
FIG. 28 is a circuit diagram that shows the structure of a gamma correction circuit serving as a comparative example.

Next, a gamma correction circuit according to a comparative example is described. As is shown in FIG. 28, the gamma correction circuit according to the comparative example is configured such that the resistors RR, RG and RB, which are switchable by the switch SW1 as shown in FIG. 23, are replaced with a variable resistor R0 that is connected between the variable resistor VR0 and resistor PKH. The other parts are common to those in FIG. 23 and are denoted by like reference symbols. A description of the common parts is omitted here.

With this structure, the gamma correction circuit of the comparative example executes gamma correction for each color, without switching the resistor R0 in accordance with the color of the gradation value.

Figure 29:
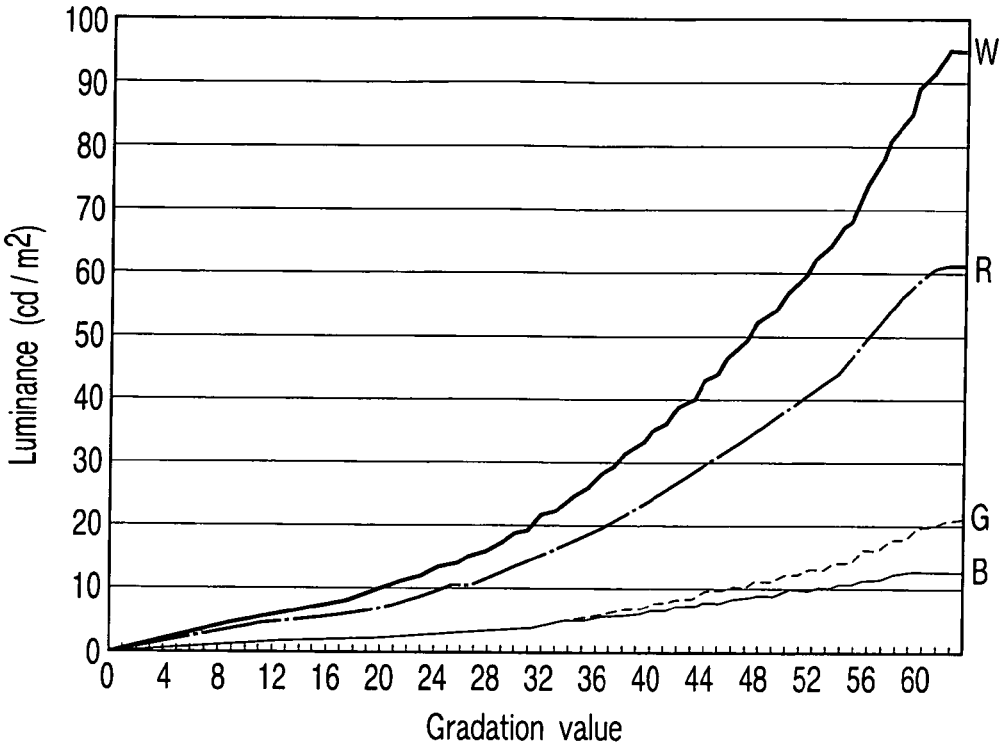
FIG. 29 is a graph that shows a relationship between a gradation value and luminance before gamma correction.

Next, a description is given of a difference in gamma correction between the gamma correction circuit 70 of the present embodiment and the gamma correction circuit of the comparative example. FIG. 29 is a graph that shows a relationship between the gradation value and luminance prior to gamma correction. The luminance characteristics of red (R), green (G) and blue (B) deviate greatly, relative to the luminance characteristic of white (W).

Figure 30:
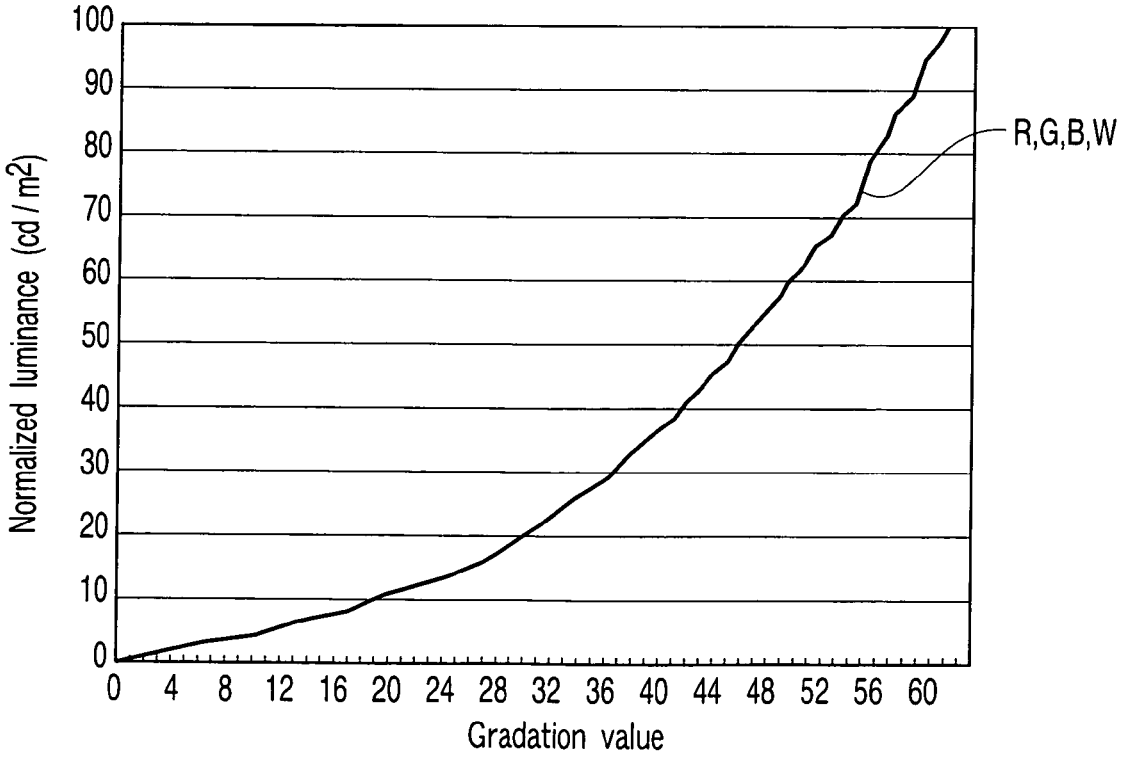
FIG. 30 is a graph that shows a relationship between a gradation value and luminance after gamma correction is executed by the gamma correction circuit shown in FIG. 23.

On the other hand, FIG. 30 is a graph that shows a relationship between the gradation value and luminance after gamma correction is executed by the gamma correction circuit 70 such that the resistors RR, RG and RB are preset at proper values and are switched in accordance with the colors of red, green and blue. As shown in FIG. 30, the luminance characteristics of red, green and blue accord with the luminance characteristic of white. The ordinate of the graph of FIG. 30 indicates normalized luminance, which is normalized such that the luminance takes value 100 when the gradation level is 63. In the graph of FIG. 30, when the gradation value is 0, the luminance is at the black level with a minimum luminance. When the gradation value is 63, the luminance is at the white level with a maximum luminance.

Figure 31:
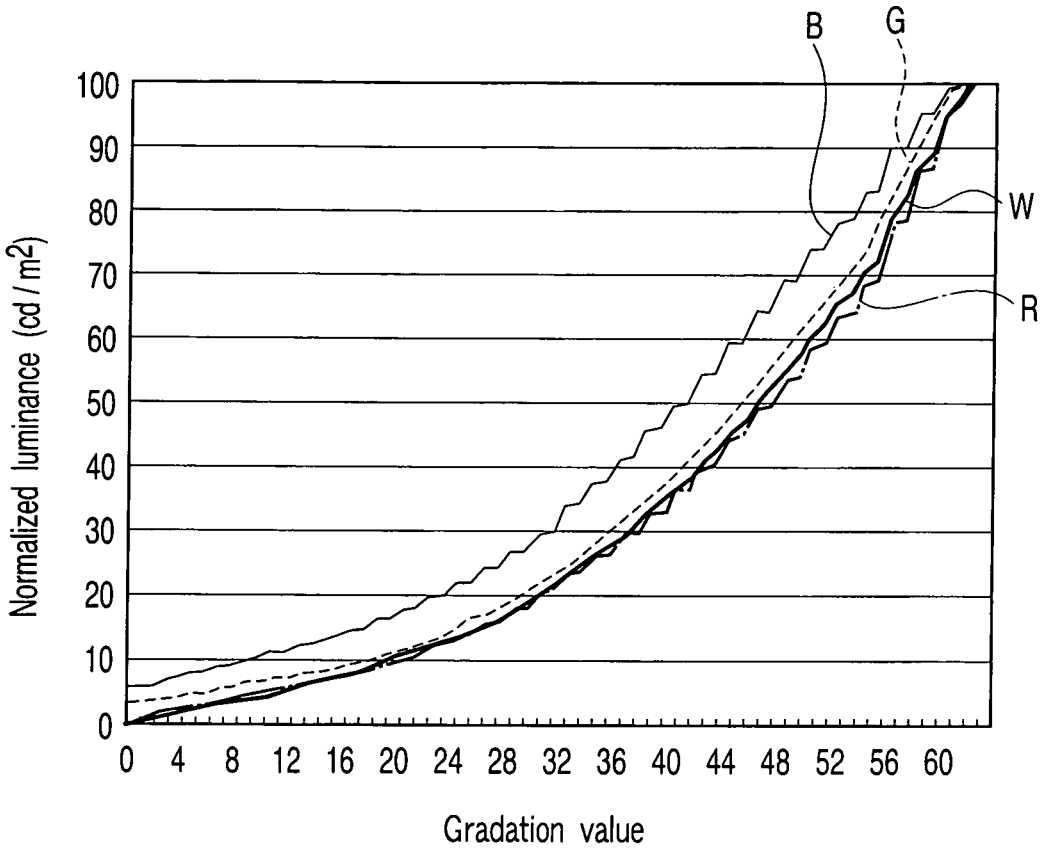
FIG. 31 is a graph that shows a relationship between a gradation value and luminance after gamma correction is executed by the gamma correction circuit serving as the comparative example and shown in FIG. 28.

By contrast, if the gamma correction circuit of the comparative example executes the same gamma correction for red, green and blue without switching the resistor R0, the luminance characteristics of red, green and blue become closer to, but do not accord with, the luminance characteristic of white, as shown in FIG. 31. In particular, the deviation of the characteristic of blue is large at the black level.

In the gamma correction circuit 70, the resistors RR, RG and RB are connected in parallel at the part for the black level. The three resistors are switched in accordance with the colors of red, green and blue. Thereby, proper gamma correction is executed at the black level.

According to the present embodiment, when 64-level gradation values, which range from the black level to the white level with respect to each of the red, green and blue, are to be converted to gradation voltages, the resistance, which corresponds to the black level in the ladder resistor section 71 that divides the reference voltage for generating gradation voltages, is switched in accordance with each color. Thereby, gamma correction is properly executed for each of the colors. Thus, the deviation in luminance characteristic of red, green and blue, relative to the gradation values, can be suppressed. In particular, when the resistance for the black level is optimized, the luminances of red, green and blue can be made completely uniform.

According to the present embodiment, the three resistors RR, RG and RB, which correspond to red, green and blue, are switchably connected in parallel at that part of the ladder resistor section for the black level. The resistors RR, RG and RB are switched in accordance with the color of the gradation value. Therefore, the resistance can be switched in accordance with colors with the simple structure. Instead of switchably providing the resistors RR, RG and RB, it is possible to substitute a variable resistor and to vary the resistance of the variable resistor in accordance with colors.

According to the present embodiment, the variable resistors VRH and VRL are provided at both ends of the central resistor PKM of the ladder resistor section 71. In addition, the inclination tuning register 72 is provided to set the resistances of the variable resistors VRH and VRL. The resistances of the variable resistors VRH and VRL are tuned in accordance with the contents of the inclination tuning register 72. Thereby, the inclination of the characteristic curve, which represents the characteristics of the gradation voltages relative to the gradation values, can be tuned.

According to the present embodiment, the variable resistors VR0 and VR1 are provided at both outermost ends of the ladder resistor section 71. In addition, the amplitude tuning register 74 is provided to set the resistances of the variable resistors VR0 and VR1. The resistances of the variable resistors VR0 and VR1 are tuned in accordance with the contents of the amplitude tuning register 74. Thereby, the amplitude of the gradation voltage can be tuned.

According to the present embodiment, the selectors 75A to 75F are connected to the intermediate resistors PKH, PKM and PKL of the ladder resistor section 71. In addition, the fine tuning register 73 is provided to set the selections by the selectors 75A to 75F. The selectors 75A to 75F select division voltages, which are output from the ladder resistor section 71, in accordance with the contents of the fine tuning register 73. Thereby, the magnitude of the gradation voltage relative to the gradation value can be tuned.

The present invention is applicable to display signal processing and display devices for converting a display signal to a gamma-corrected pixel voltage.

What is claimed is:

1. A display signal processing device comprising:

a reference gradation voltage generating circuit that generates a first predetermined number of reference gradation voltages;

a source drive comprising a digital-to-analog converting circuit that converts a display signal to a pixel voltage by selectively using the first predetermined number of reference gradation voltages from said reference gradation voltage generating circuit; and a control section that controls said source drive and said reference gradation voltage generating circuit, wherein said reference gradation voltage generating circuit includes a resistance circuit comprising a plurality of resistors connected in series, and a second predetermined number of variable voltage generating sections connected to both ends of said resistance circuit and to a predetermined connecting section of connecting sections of the plurality of resistors, the second predetermined number being less than the first predetermined number, said second predetermined number of variable voltage generating sections comprises a digital-to-analog converter that converts a plurality of numeral data supplied from said control section into output voltages which are each varied for gamma correction, and supplies the output voltages to said resistance circuit, and difference voltages between output terminals of said variable voltage generating sections are divided by said resistance circuit and the first predetermined number of reference gradation voltages are derived.

2. The display signal processing device according to claim 1, wherein said reference gradation voltage generating circuit includes a protection circuit that protects said digital-to-analog converting circuit by detecting abnormality in output voltage occurring in any one of said second predetermined number of variable voltage generating sections, and switching output voltages of all the variable voltage generating sections to a specified voltage.

3. The display signal processing device according to claim 1, wherein said control section includes an output section that serially outputs items of numeral data, which are to be converted by said digital-to-analog converter, in an order beginning with one with a longest conversion period.

4. The display signal processing device according to claim 1, further comprising:

a correction circuit that is disposed on an output side of said variable voltage generating sections, the correction circuit selectively correcting the first predetermined number of reference gradation voltages to eliminate a difference in the gradations for at least one of the vicinity of the minimum luminance and the vicinity of the maximum luminance, and delivers the corrected reference gradation voltage to said digital-to-analog converting circuit.

5. The display signal processing device according to claim 1, wherein said control section includes a correction circuit that corrects the display signal to eliminate a difference in the gradations for at least one of the vicinity of the minimum luminance and the vicinity of the maximum luminance, and delivers the corrected display signal to said digital-to-analog converting circuit.

6. The display device according to claim 1, wherein the control section is configured to execute a control of setting the first predetermined number of reference gradation voltages at a predetermined identical level prior to turning off of power.

* * * * *